US011621157B2

(12) United States Patent
Shin et al.

(10) Patent No.: US 11,621,157 B2
(45) Date of Patent: Apr. 4, 2023

(54) EXTERNAL ELECTRODE FLUORESCENT LAMP AND HOME APPLIANCE INCLUDING THE SAME

(71) Applicants: Samsung Electronics Co., Ltd., Suwon-si (KR); EI Lighting Co., LTD., Incheon (KR)

(72) Inventors: Myungju Shin, Suwon-si (KR); Myonggi Jang, Incheon (KR); Youngchul Ko, Suwon-si (KR); Donghyo Kim, Suwon-si (KR); Jongwook Joo, Suwon-si (KR); Daehyun Sung, Incheon (KR); Jaegeun Ji, Dongducheon-si (KR)

(73) Assignees: Samsung Electronics Co., Ltd., Suwon-si (KR); EI Lighting Co., Ltd., Incheon (KR)

( * ) Notice: Subject to any disclaimer, the term of this patent is extended or adjusted under 35 U.S.C. 154(b) by 0 days.

(21) Appl. No.: 17/702,590

(22) Filed: Mar. 23, 2022

(65) Prior Publication Data

US 2022/0285144 A1 Sep. 8, 2022

Related U.S. Application Data

(63) Continuation of application No. PCT/KR2022/001833, filed on Feb. 7, 2022.

(30) Foreign Application Priority Data

Mar. 8, 2021 (KR) ..... 10-2021-0030441

(51) Int. Cl.
*H01J 65/04* (2006.01)
*H01J 61/36* (2006.01)
(Continued)

(52) U.S. Cl.
CPC ..... *H01J 61/366* (2013.01); *H01J 61/09* (2013.01); *H01J 61/12* (2013.01); *H01J 61/42* (2013.01); *H01J 65/042* (2013.01)

(58) Field of Classification Search
CPC ..... H01J 65/042
(Continued)

(56) References Cited

FOREIGN PATENT DOCUMENTS

JP 3803492 B2 8/2006
JP 2010003419 A * 1/2010
(Continued)

OTHER PUBLICATIONS

International Search Report and Written Opinion of the International Searching Authority dated May 26, 2022, in connection with International Application No. PCT/KR2022/001833, 7 pages.

*Primary Examiner* — Christopher M Raabe

(57) ABSTRACT

A rare gas lamp device is disclosed. The rare gas lamp device includes: a lamp body provided in a shape of a cylinder to contain a rare gas and a fluorescent material for emitting light; a plurality of cap electrodes fixed to both ends of the lamp body; a plurality of band electrodes extending in a length direction from the plurality of cap electrodes and arranged opposite to each other with respect to a center axis of the lamp body, and positioned on a circumferential surface of the lamp body, wherein a light-emitting area of the lamp body is an exposed surface of the circumferential surface of the lamp body between the plurality of band electrodes; a spring holder coupled with each of the plurality of cap electrodes and configured to apply a voltage to the band electrodes through the plurality of cap electrodes, the spring holder including a first fixing part configured to support a first side of the cap electrode, a second fixing part configured to support a second side of the cap electrode, and an inserting opening formed between a first end of the first
(Continued)

fixing part and a first end of the second fixing part such that the cap electrode is inserted in the inserting opening; and a stopper protruding from each of the plurality of cap electrodes, wherein, when each of the plural of cap electrodes is inserted through the inserting opening, the stopper is interfered by the first end of the first fixing part or the first end of the second fixing part to restrict the light-emitting area from rotating about the center axis of the lamp body.

14 Claims, 24 Drawing Sheets

(51) Int. Cl.
*H01J 61/12* (2006.01)
*H01J 61/42* (2006.01)
*H01J 61/09* (2006.01)

(58) Field of Classification Search
USPC ..... 313/618
See application file for complete search history.

(56) References Cited

FOREIGN PATENT DOCUMENTS

| | | | |
|---|---|---|---|
| KR | 10-2001-0066758 | A | 7/2001 |
| KR | 10-2006-0014270 | A | 2/2006 |
| KR | 10-2007-0017898 | A | 2/2007 |
| KR | 10-0764849 | B1 | 10/2007 |
| KR | 10-2010-0103055 | A | 9/2010 |
| KR | 10-2010-0126172 | A | 12/2010 |
| KR | 10-2011-0048183 | A | 5/2011 |
| KR | 10-2019-0056838 | A | 5/2019 |

* cited by examiner

EXTERNAL ELECTRODE FLUORESCENT LAMP AND HOME APPLIANCE INCLUDING THE SAME

CROSS-REFERENCE TO RELATED APPLICATIONS

This application is a continuation of International Patent Application No. PCT/KR2022/001833 filed on Feb. 7, 2022, which is based on and claims priority under 35 U.S.C. § 119 to Korean Patent Application No. 10-2021-0030441 filed on Mar. 8, 2021, in the Korean Intellectual Property Office, the disclosures of which are herein incorporated by reference in their entirety.

BACKGROUND

1. Field

The present disclosure relates to an external electrode fluorescent lamp and a home appliance including the same.

2. Description of Related Art

Typical fluorescent lamps include a type using an internal electrode inside a glass tube, such as a Hot Cathode Fluorescent Lamp (HCFL) and a Cold Cathode Fluorescent Lamp (CCFL), and a type using a glass tube external electrode, such as an External Electrode Fluorescent Lamp (EEFL).

The external electrode fluorescent lamp uses a method by which a glass tube itself acts as dielectrics to induce discharges and emit light. The external electrode fluorescent lamp can be driven with a low voltage, and accordingly, has advantages in view of a life cycle, consumption power, etc. compared with the cold cathode fluorescent lamp.

Among external electrode fluorescent lamps, there is a lamp in which a pair of band-shaped external electrodes are opposite to each other along an extension direction of a glass tube on the surface of the glass tube in order for the glass tube to itself act as dielectrics to induce discharges. The lamp is also called a capacitive discharge lamp with counter electrodes. Hereinafter, the external electrode fluorescent lamp including a pair of band-shaped electrodes along an extension direction of a glass tube on the surface of the glass tube will be referred to a counter type external electrode fluorescent lamp.

In the counter type external electrode fluorescent lamp, a rare gas (an inert gas) such as a Xenon gas is filled in the glass tube, a fluorescent material is coated on the inner surface, and the pair of band-shaped external electrodes being opposite to each other is attached to the outer surface. A voltage is applied to the pair of band-shaped electrodes by directly connecting the pair of band-shaped electrodes to holders made of a metal material and clamping the lamp at both ends, or by connecting the lamp to cap electrodes positioned at both ends and connecting the cap electrodes to holders.

When the metal holders are connected to an inverter and an external power source to apply a high-frequency alternating current voltage to the pair of band-shaped external electrodes, a discharge occurs through the Xenon gas and ultraviolet light is emitted through an Eximer reaction.

However, there was a problem that light generated from the lamp fails to be transmitted through the external electrodes positioned on the outer surface of the lamp according to a state in which the lamp is fixed to the holders, and thus the illuminance of the lamp deteriorates.

An aspect of the present disclosure provides a lamp device, as an External Electrode Fluorescent Lamp (EEFL), in which an exposed surface of a lamp body, exposed between a first band electrode and a second band electrode, that is, external electrodes stably faces an object.

SUMMARY

A rare gas lamp device according to a concept of the present disclosure includes: a lamp body provided in a shape of a cylinder to contain a rare gas and a fluorescent material for emitting light; a plurality of cap electrodes fixed to both ends of the lamp body; a plurality of band electrodes extending in a length direction from the plurality of cap electrodes and arranged opposite to each other with respect to a center axis of the lamp body, and positioned on a circumferential surface of the lamp body, wherein a light-emitting area of the lamp body is an exposed surface of the circumferential surface of the lamp body between the plurality of band electrodes; a spring holder coupled with each of the plurality of cap electrodes and configured to apply a voltage to the band electrodes through the plurality of cap electrodes, the spring holder including a first fixing part configured to support a first side of the cap electrode, a second fixing part configured to support a second side of the cap electrode, and an inserting opening formed between a first end of the first fixing part and a first end of the second fixing part such that the cap electrode is inserted in the inserting opening; and a stopper protruding from each of the plurality of cap electrodes, wherein, when each of the plural of cap electrodes is inserted through the inserting opening, the stopper is interfered by the first end of the first fixing part or the first end of the second fixing part to restrict the light-emitting area from rotating about the center axis of the lamp body.

The stopper may include a first stopper supported by the first fixing part, and a second stopper supported by the second fixing part.

Each of the plurality of cap electrodes may be in a shape of a cylinder including a hollow space, and the first stopper or the second stopper may be in a shape of a plate protruding outward in a radial direction for each of the plurality of cap electrodes.

The spring holder may further include a supporting portion to which a second end of the first fixing part and a second end of the second fixing part are fixed, and the rare gas lamp device may further include a third stopper protruding outward in a radial direction of each of the plurality of cap electrodes toward the supporting portion from the cap electrode, and any one of the first fixing part or the second fixing part catches the third stopper when the lamp body rotates.

Each of the plurality of cap electrodes may be in a shape of a cylinder having a hollow space.

The stopper may protrude from an outer surface of each of the plurality of cap electrodes to include a first surface interfered by the first end of the first fixing part, a second surface interfered by the first end of the second fixing part, and a connecting surface connecting the first surface to the second surface and extending along a circumferential direction of the cap electrode.

The spring holder may further include a supporting portion to which a second end of the first fixing part and a second end of the second fixing part are fixed, the supporting portion may include a fixing protrusion protruding toward each of the plurality of cap electrodes from the supporting portion, each of the plurality of cap electrodes may further include a fixing hole corresponding to the fixing protrusion, and, when the fixing protrusion is inserted in the fixing hole and supported by an inner side of the fixing hole, the lamp body may be restricted from moving in an extension direction of the lamp body.

The spring holder may further include a supporting portion to which a second end of the first fixing part and a second end of the second fixing part are fixed, each of the plurality of cap electrodes may further include a fixing protrusion protruding toward the supporting portion, the supporting portion may include a fixing hole corresponding to the fixing protrusion, and the fixing protrusion may be inserted in the fixing hole and supported by the fixing hole.

Each of the plurality of cap electrodes may include a first cap electrode fixed to a first end of the lamp body in the a direction, and a second cap electrode fixed to the second end of the lamp body in the a direction, each of the plurality of band electrodes may include a first band electrode first band electrode connected to the first cap electrode, and a second band electrode positioned on an outer surface of the lamp body in such a way as to be opposite to the first band electrode, the second band electrode extending in the a direction from the cap electrode and connected to the second cap electrode, and a plurality of spring holders in which the first cap electrode and the second cap electrode are respectively inserted may be provided.

The light-emitting area may be positioned between the first band electrode and the second band electrode and aligned with the inserting opening.

The rare gas lamp device may further include a shatter-resistant film surrounding a part of the lamp body and a part of each of the plurality of cap electrodes, wherein a first end of the shatter-resistant film may be spaced from the spring holder.

A distance between the first end of the shatter-resistant film and the spring holder may be 0.1 mm or more.

Each of the plurality of cap electrodes and the spring holder may be made of a metal material.

The rare gas lamp device may be External Electrode Fluorescent Lamp (EEFL).

A home appliance according to a concept of the present disclosure includes: a lamp body provided as an External Electrode Fluorescent Lamp (EEFL) and emitting light, the lamp body being in a shape of a cylinder; a cap electrode provided as a first cap electrode and a second cap electrode respectively fixed to both ends of the lamp body while surrounding a part of an outer surface of the lamp body, each of the first cap electrode and the second cap electrode being in a shape of a cylinder; a first band electrode and a second band electrode positioned on the outer surface of the lamp body in such a way as to be opposite to each other, wherein the first band electrode is connected to the first cap electrode and the second band electrode is connected to the second cap electrode; a plurality of spring holders including a first fixing part and a second fixing part to clamp the first cap electrode or the second cap electrode, wherein each of the plurality of spring holders includes an inserting opening which is formed by a distance between a first end of the first fixing part and a first end of the second fixing part and into which the cap electrode is inserted; and a stopper protruding outward in a radial direction of the cap electrode from an outer surface of the cap electrode to be interfered by the first end of the first fixing part and the first end of the second fixing part, wherein an exposed surface of the lamp body, exposed between the first band electrode and the second band electrode, is aligned with the inserting opening.

The first fixing part may support a first side of the cap electrode, and the second fixing part may support a second side of the lamp, the stopper may include a first stopper supported by the first fixing part and a second stopper supported by the second fixing part, and the first stopper or the second stopper may be in a shape of a plate protruding outward in the radial direction of the cap electrode.

The stopper may protrude from an outer surface of the first cap electrode to include a first surface interfered by a first end of the first fixing part, a second surface interfered by a first end of the second fixing part, and a connecting surface connecting the first surface to the second surface and extending along a circumferential direction of the cap electrode.

The spring holder may further include a supporting portion to which a second end of the first fixing part and a second end of the second fixing part are fixed, and the rare gas lamp device may further include a third stopper protruding outward in a radial direction of the cap electrode toward the supporting portion from the cap electrode, wherein the third stopper may be caught by any one of the first fixing part or the second fixing part when the lamp body rotates.

The spring holder may further include a supporting portion to which the second end of the first fixing part and the second end of the second fixing part are fixed, the supporting portion may include a fixing protrusion protruding toward the cap electrode, and the cap electrode may further include a fixing hole corresponding to the fixing protrusion, wherein the fixing protrusion may be inserted in the fixing hole and fixed.

The spring holder may further include a supporting portion to which the second end of the first fixing part and the second end of the second fixing part are fixed, the cap electrode may further include a fixing protrusion protruding toward the supporting portion, and the supporting portion may include a fixing hole corresponding to the fixing protrusion, wherein the fixing protrusion may be inserted in the fixing hole and fixed.

In a lamp device according to the present disclosure, an exposed surface of a lamp body may stably face an object because stoppers protruding from cap electrodes fixed to both ends of the lamp body interfere with spring holders fixing the cap electrodes.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
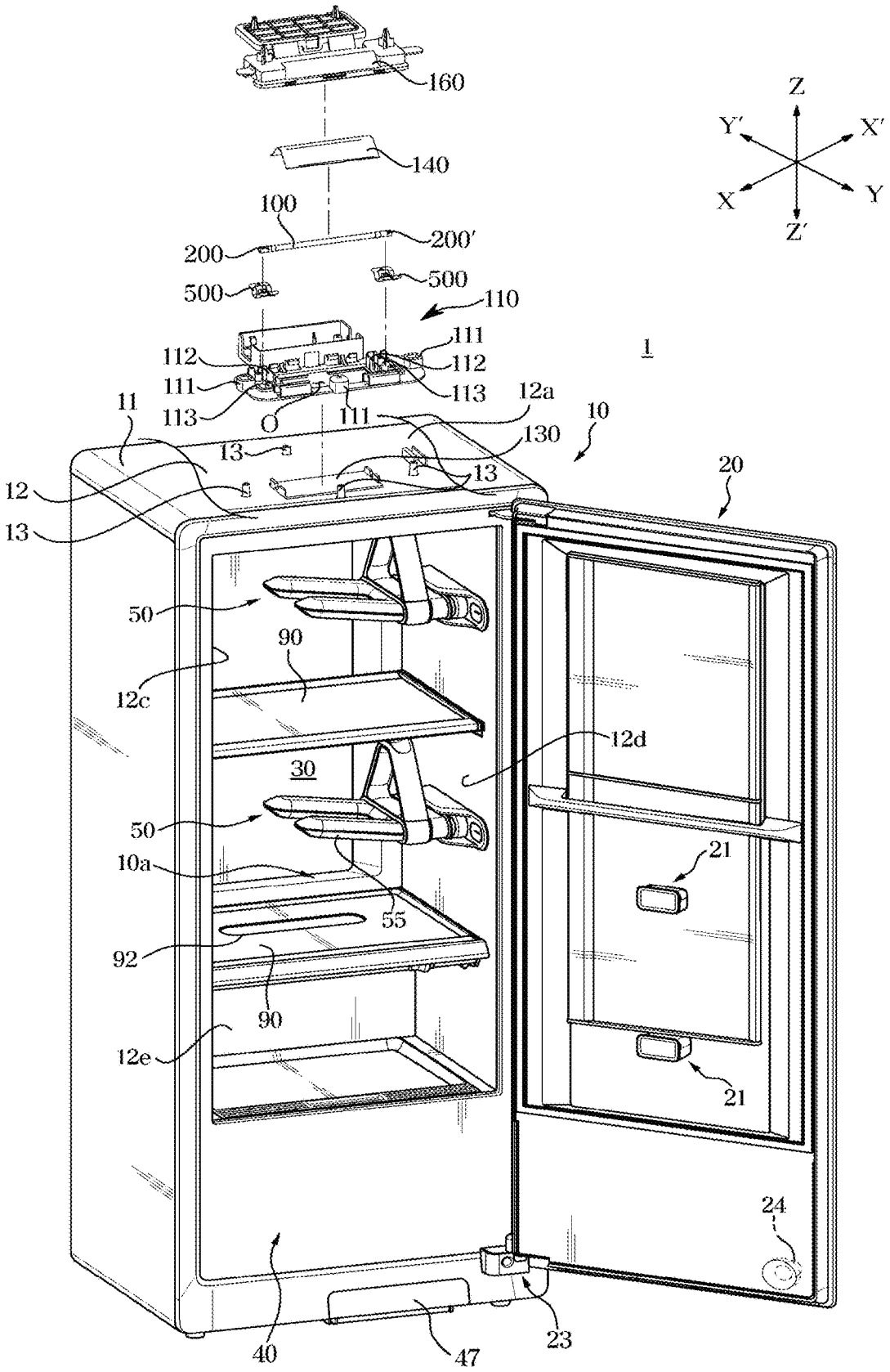
FIG. 1 shows a shoe care apparatus in which a lamp device according to an embodiment of the disclosure is installed.

FIGS. 1 through 24, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in the specification and configurations illustrated in the drawings are merely preferred examples of the embodiments of the disclosure, and may be modified in various different ways at the time of filing of the present application to replace the embodiments and drawings of the specification.

Also, like reference numerals or symbols denoted in the drawings of the present specification represent members or components that perform the substantially same functions.

The terms used in the present specification are merely used to describe embodiments, and are not intended to limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms "first," "second," etc. may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Hereinafter, the embodiments of the disclosure will be described in detail with reference to the accompanying drawings.

Figure 2:
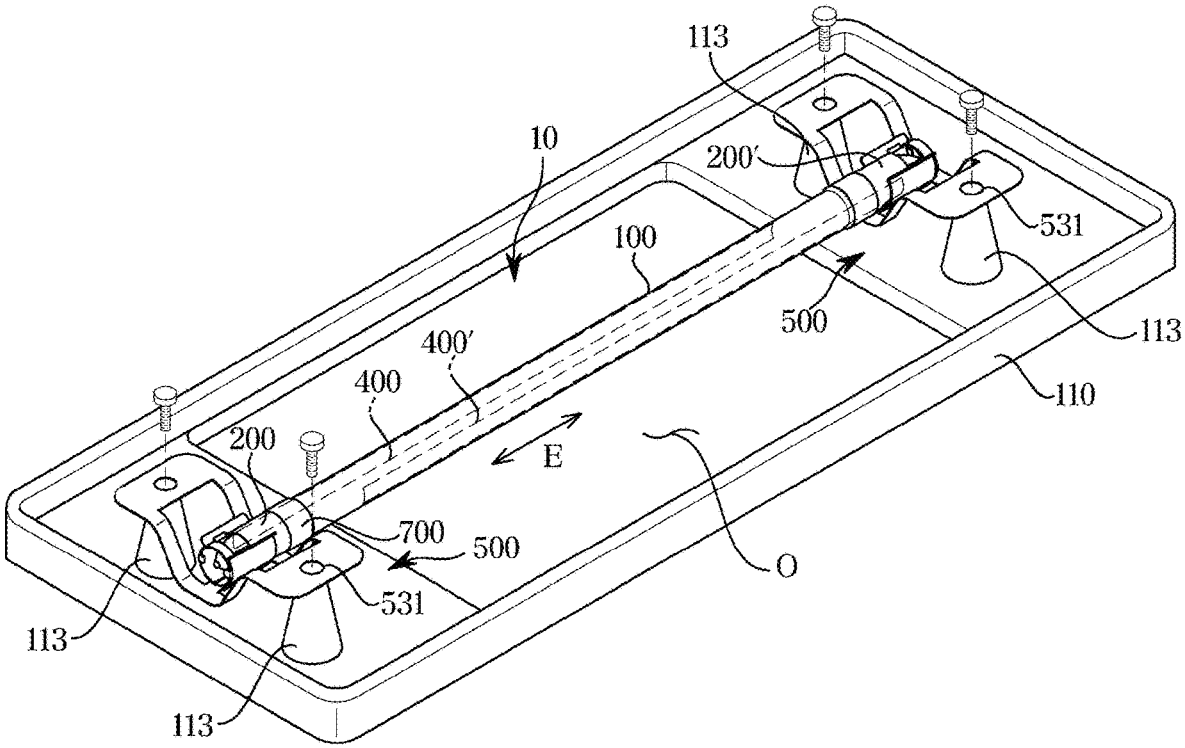
FIG. 2 is a perspective view of a lamp device according to an embodiment of the disclosure.
Figure 2:
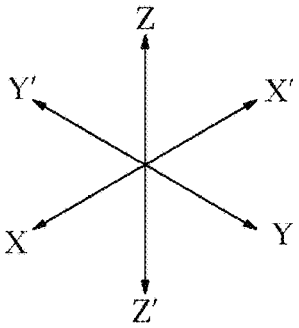
Figure 3:
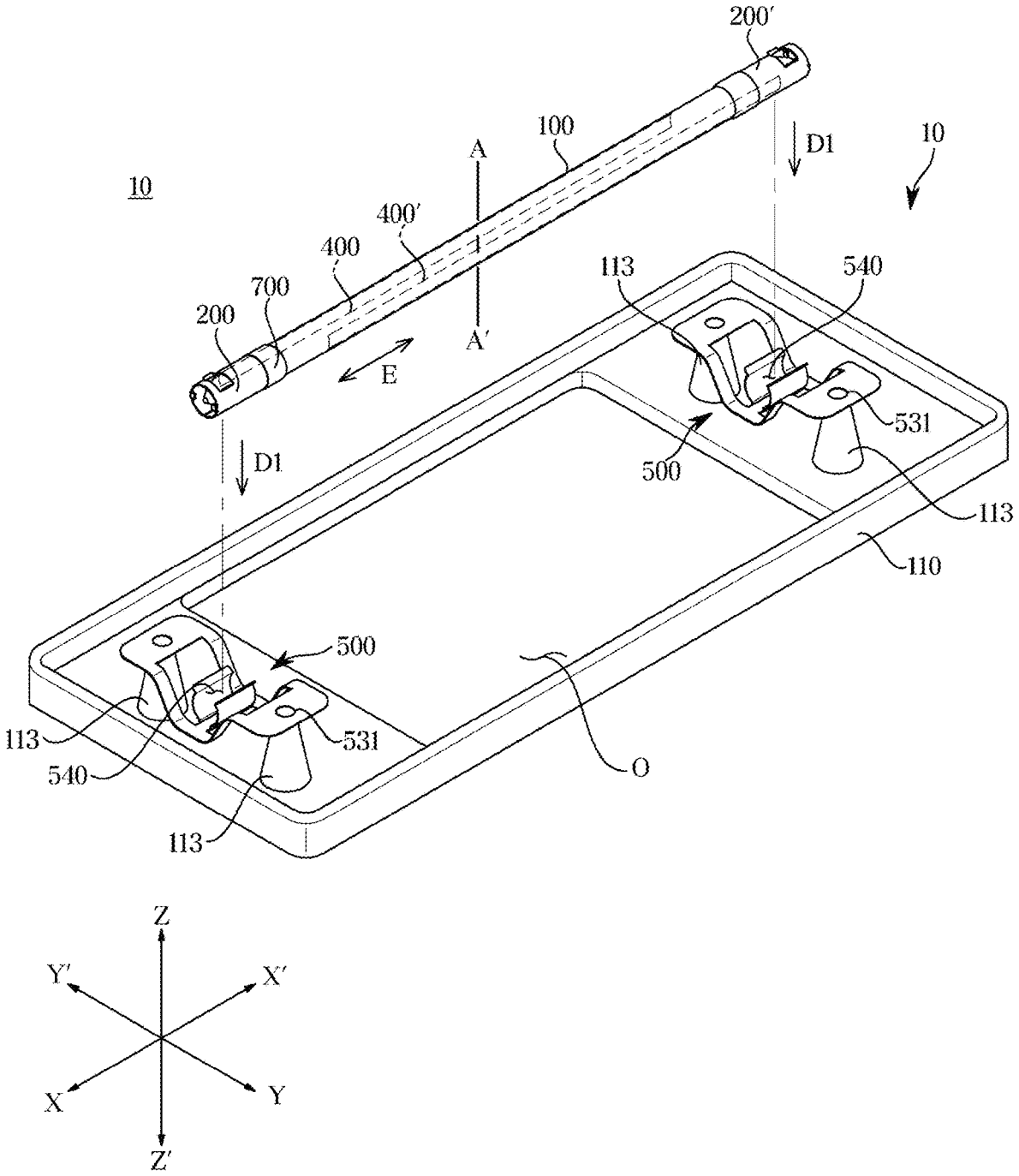
FIG. 3 is a perspective view showing a process in which a lamp assembly is installed in a spring holder.
Figure 4:
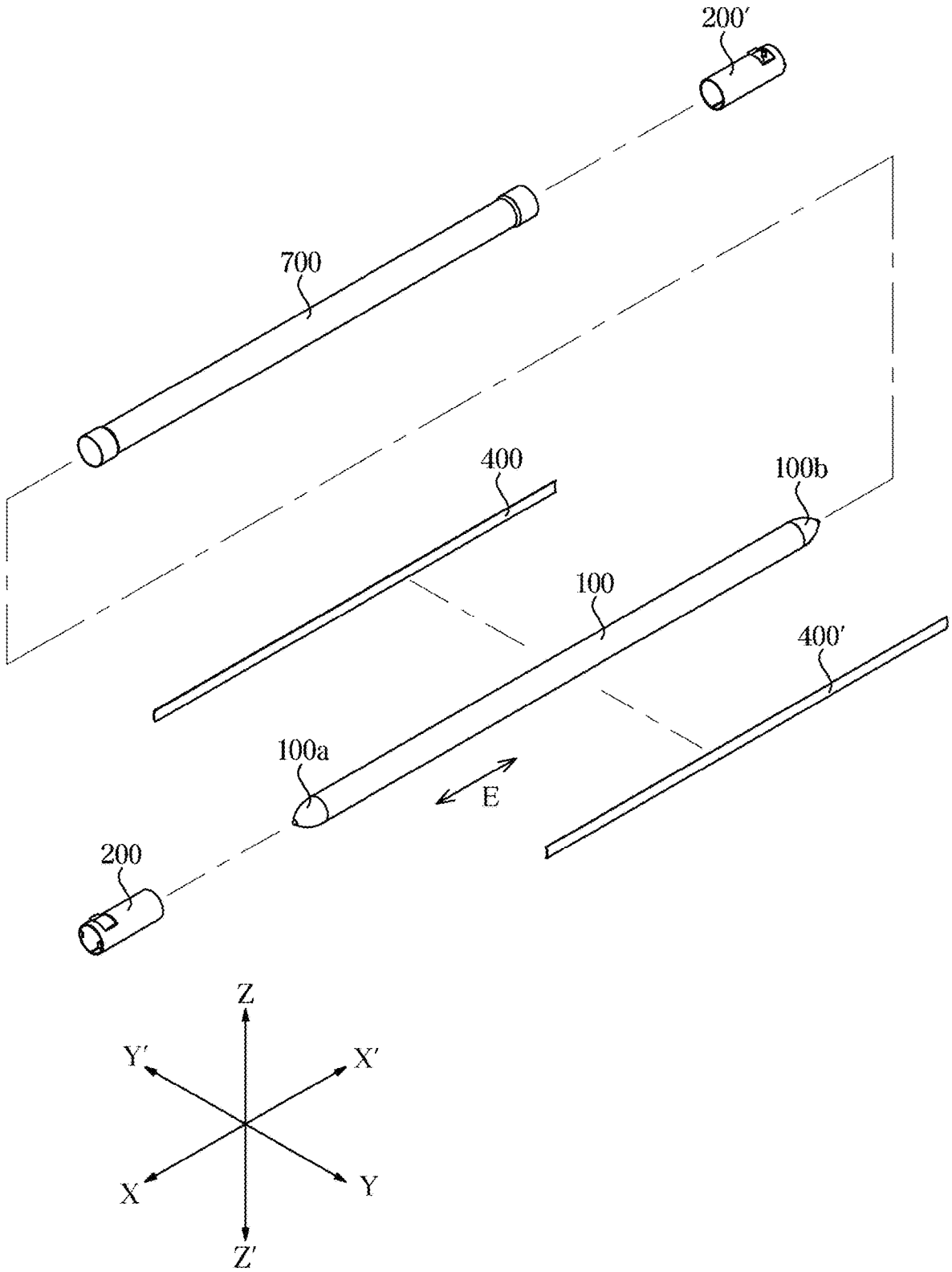
FIG. 4 is an exploded perspective view of the lamp assembly of FIG. 3.
Figure 5:
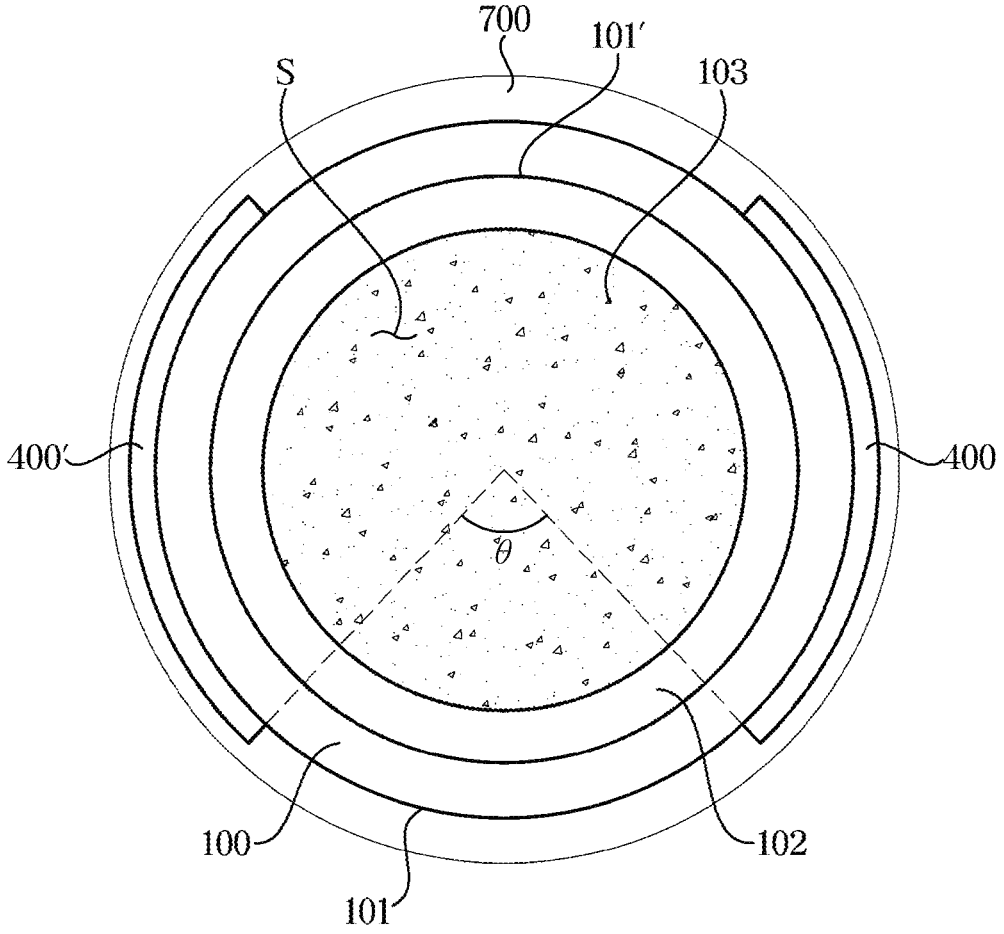
FIG. 5 is a cross-sectional view of a lamp body of FIG. 3, taken along line A-A'.
Figure 6:
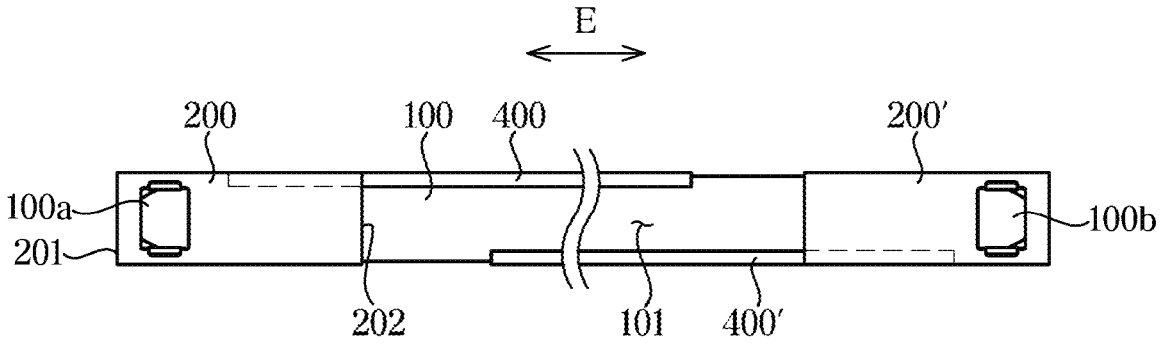
FIG. 6 is a front view of the lamp assembly of FIG. 3.
Figure 7:
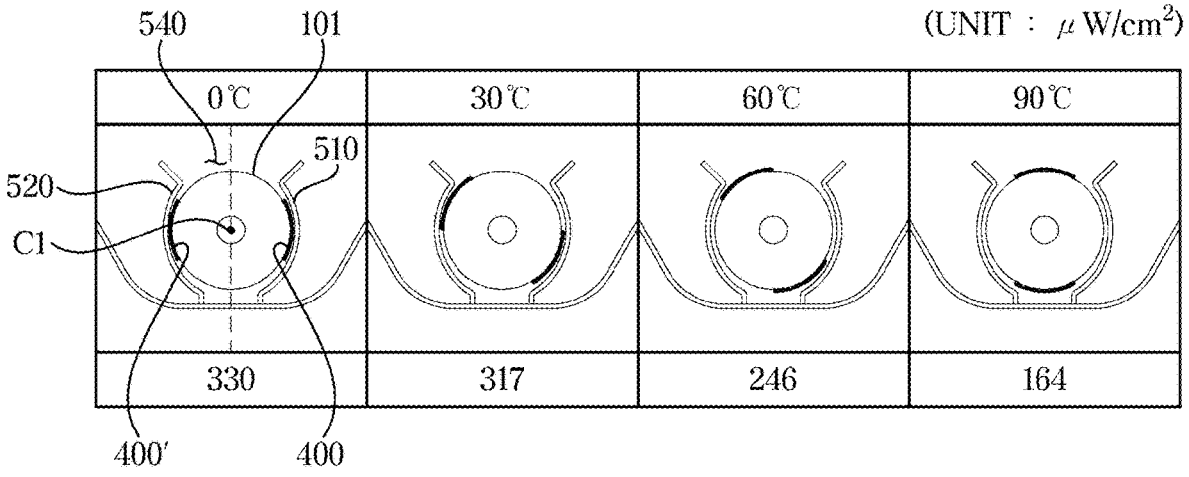
FIG. 7 is a table representing UVC intensities according to angles of an object with respect to counter electrodes configured with a pair of band electrodes.

FIG. 1 shows a shoe care apparatus in which a lamp device according to an embodiment of the disclosure is applied. FIG. 2 is a perspective view of a lamp device according to an embodiment of the disclosure. FIG. 3 is a perspective view showing a process in which a lamp assembly is installed in a spring holder. FIG. 4 is an exploded perspective view of the lamp assembly of FIG. 3. FIG. 5 is a cross-sectional view of a lamp body of FIG. 3, taken along line A-A'. FIG. 6 is a front view of the lamp assembly of FIG. 3. FIG. 7 is a table representing UVC intensities according to angles of an object with respect to counter electrodes configured with a pair of band electrodes.

Referring to FIG. 1, a shoe care apparatus 1 may include a main body 10*b* forming an outer appearance, and a door 20 rotatably coupled with the main body 10*b*.

The main body 10*b* may be provided in a shape of a rectangular parallelepiped of which a front side opens. In the open front side of the main body 10*b*, an opening 10*a* may be formed. The door 20 may be rotatably coupled with the main body 10*b* to open or close the open front side of the main body 10*b*. The door 20 may be coupled with the main body 10*b* through a hinge 23, etc.

The door 20 may include a rack member 21 provided on a surface facing the inside of a shoe care room 30. At least one rack member 21 may be provided. The rack member 21 may hang a handle 55 of a shoe supporting device 50 which will be described below to easily store the shoe supporting device 50. However, the purpose of use of the rack member 21 is not limited to this, and the rack member 21 may be used to hang another configuration.

The door 20 may further include a display provided on a front surface of the shoe care apparatus 1. A user may set an appropriate care course through the display according to a kind of shoes which he/she wants to care. Thereby, temperature and humidity of the shoe care room 30 may be adjusted to reduce damage to the shoes.

In a lower portion of the door 20, an opening and closing sensor 24 may be provided to sense opening/closing of the door 20. The opening and closing sensor 24 may be a reed switch. However, the opening and closing sensor 24 is not limited to a reed switch, and may include various kinds of sensors. In the case in which the opening and closing sensor 24 is a reed switch, magnetism may be maintained while the door is closed, and when the door is opened, the magnetism may disappear. Through this, a processor (not shown) may determine an opened/closed state of the door 20. In the drawing, the opening and closing sensor 24 is located in the lower portion of the door 20. However, the location of the opening and closing sensor 24 is not limited to this, and the opening and closing sensor 24 may be positioned at various locations. Also, an additional opening and closing sensor 24 may be provided inside the main body 10*b*.

The main body 10*b* may include an external cabinet 11, and an internal cabinet 12 installed inside the external cabinet 11. The internal cabinet 12 is also referred to as a cabinet 12.

The shoe care apparatus 1 may include the shoe supporting device 50 installed inside the shoe care room 30 to support shoes.

The shoe care room 30 may form a space in which shoes are accommodated. The shoe care room 30 may be provided inside the internal cabinet 12. The shoe care room 30 is also referred to as a processing chamber.

The internal cabinet 12 may include a frame (not shown) supporting a top wall 12*a*, a bottom wall, a left wall 12*c*, a right wall 12*d*, and a rear wall 12*e*.

Inside the internal cabinet 12, the shoe care room 30 may be provided to care for shoes.

The shoe care apparatus 1 may include a machine room 40 including a heat exchanger 47, etc. to dehumidify or heat inside air of the shoe care room 30. The machine room 40 may be provided below the shoe care room 30.

The shoe supporting device 50 may be installed on the left wall 12*c* or the right wall 12*d* of the shoe care room 30. That is, the shoe supporting device 50 may be positioned to show the sides of shoes from a front side of the shoe care apparatus 1. Accordingly, a lateral length of the shoe supporting device 50 may be shortened.

The shoe supporting device 50 may be detachably installed in the shoe care room 30. At least one shoe supporting device 50 may be provided. The shoe supporting device 50 may be formed to hang shoes thereon.

The shoe care apparatus 1 may further include the shoe supporting device 50.

The shoe supporting device 50 may be detachably mounted on an inner surface of a side wall of the internal cabinet 12. That is, the shoe supporting device 50 may be coupled with the left wall 12*c* of the shoe care room 30. However, a location of the shoe supporting device 50 is not limited to this, and the shoe supporting device 50 may be positioned on the right wall 12*d* of the shoe care room 30 as long as heated air is supplied thereto.

The shoe supporting device 50 may be detachably coupled with the internal cabinet 12. Accordingly, when a shoe holder (not shown) for long boots is installed in the shoe care room 30 or when shoes are put on a plate 90, the shoe supporting device 50 may be detached from the internal cabinet 12 to utilize a space.

The shoe care apparatus may include a sterilizer. The sterilizer may be installed on the top wall 12*a* of the internal cabinet. For example, the sterilizer may be positioned between the external cabinet 11 and the internal cabinet 12. Accordingly, the sterilizer may be not exposed to the outside, which improves esthetics of the shoe care apparatus.

The sterilizer may sterilize outer covers of shoes hold on the shoe supporting device 50. Accordingly, shoes positioned in the shoe care room 30 may be sterilized. The sterilizer may be positioned on the top wall 12*a* to sterilize shoes. However, a location of the sterilizer is not limited to this example. Accordingly, the sterilizer may be positioned on the left wall 12*c* or the right wall 12*d*. Also, the sterilizer may be positioned on the rear wall 12*e* or the door. The sterilizer may be positioned on all walls except for a wall on which the shoe supporting device 50 is mounted. Because the sterilizer can be positioned at various locations in the shoe care apparatus, the sterilizer may enable free space utilization of the shoe care apparatus.

The main body 10*b* may include the external cabinet 11 and the internal cabinet 12. In the top wall 12*a* of the internal cabinet 12, the sterilizer may be mounted. For example, the sterilizer may be positioned between the external cabinet 11 and the internal cabinet 12.

The sterilizer may include cases 110 and 160, a lamp device 10, a protective plate 130, and a reflective member 140.

The lamp device 10 may include a lamp body 100, cap electrodes 200 and 200' fixed to both ends of the lamp body 100, a pair of band electrodes 400 and 400' electrically connected to the cap electrodes 200 and 200', and spring holders 500 fixing the cap electrodes 200 and 200'. Details about a structure of the lamp device 10 will be described below.

The cases 110 and 160 may accommodate the lamp device 10, the protective plate 130, and the reflective member 140.

The cases 110 and 160 may include a first case 110 and a second case 160. The first case 110 may be a lower case 110, and the second case 160 may be an upper case 160. For example, the first case 110 may be positioned below the lamp device 10 to accommodate the lamp device 10, and the second case 160 may be positioned above the lamp device 10 to accommodate the lamp device 10.

The first case 110 may be coupled with the top wall 12*a*. The first case 110 may be coupled with a coupling protrusion 13 provided on the top wall 12*a*. The first case 110 may include top wall coupling portions 111, resting grooves 112, and spring holder coupling portions 113.

The first case 110 may further include an opening O opening toward the shoe care room 30 to irradiate ultraviolet light generated from the lamp device 10 to the shoe care room 30.

The top wall coupling portion 111 may be formed in a shape corresponding to the coupling protrusion 13 provided on the top wall 12*a*. For example, the top wall coupling portion 111 may be formed in a shape of a hole or a groove. However, the shape of the top wall coupling portion 111 is not limited to this.

The resting groove 112 may be recessed such that the spring holder 500 of the lamp device 10 is rested on the resting groove 112. The resting groove 112 may be provided in a shape corresponding to the lamp device 10 and the spring holders 500. For example, the resting groove 112 may be recessed in a shape of a circle to correspond to a cylinder shape. However, the shape of the resting groove 112 is not limited to this.

The spring holder coupling portion 113 may be provided in a shape corresponding to the spring holder 500 to be coupled with the spring holder 500. For example, the spring holder coupling portion 113 may be provided as a protrusion. However, the shape of the spring holder coupling portion 113 is not limited to this.

The spring holder coupling portion 113 may be provided to correspond to the number of the spring holder 500. For example, two spring holder coupling portions 113 may be provided.

The lamp device 10 may be installed in the cases 110 and 160 to irradiate ultraviolet light for sterilizing shoes. Also, the lamp device 10 may irradiate UVC. However, the lamp device 10 may irradiate UVA or UVB.

The spring holder 500 may be coupled with the first case 110. A plurality of spring holders 500 may be provided. For example, the spring holders 500 may be coupled with both sides of the lamp device 10. The spring holder 500 may be coupled with the spring holder coupling portion 113 of the first case 110. The shape of the spring holder 500 may correspond to that of the spring holder coupling portion 113.

The protective plate 130 may cover the opening O of the first case 110, opening toward the inside of the shoe care room 30. The shape of the protective plate 130 may correspond to that of the opening O of the first case 110. Referring to FIG. 1, the protective plate 130 may be formed in a shape of a rectangle corresponding to the opening O. However, the shapes of the opening O and the protective plate 130 are not limited to these.

The protective plate 130 may prevent a user from contacting the lamp device 10 installed inside the cases 110 and 160. For example, a hole may be formed in the top wall 12*a* to irradiate ultraviolet light to shoes, and the protective plate 130 may close the hole. Accordingly, the protective plate 130 may prevent the user from being damaged. The protective plate 130 may be in a shape of a mesh, or include a quartz glass material. However, the shape and material of the protective plate 130 are not limited to the above-mentioned examples.

The reflective member 140 may reflect ultraviolet light emitted from the lamp device 10. The reflective member 140 may be positioned above the lamp device 10. Accordingly, ultraviolet light emitted upward may be reflected downward by the reflective member 140, and ultraviolet light from the lamp device 10 may be emitted only toward shoes.

The second case 160 may be coupled with the first case 110 to accommodate the lamp device 10, the reflective member 140, etc. The second case 160 may be coupled with an upper portion of the first case 110.

Referring to FIGS. 2 and 3, the lamp device 10 according to an embodiment of the disclosure may include the lamp body 100, the cap electrodes 200 and 200' fixed to both ends of the lamp body 100, the pair of band electrodes 400 and 400' electrically connected to the cap electrodes 200 and 200', and the spring holders 500 fixing the cap electrodes 200 and 200'.

The lamp body 100 shown in FIGS. 1 to 6 is provided as one piece, however, a plurality of lamp devices 10 may be applied according to a kind, size, or specification of a home appliance to which the lamp device 10 is applied. In this case, a plurality of lamp bodies 100 may be also provided. The lamp bodies 100 may be aligned in series along an extension direction E of each lamp body 100, or the lamp bodies 100 may be arranged side by side in parallel in a direction that is perpendicular to the extension direction E of each lamp body 100.

In FIGS. 2 and 3, the first case 110 to which the lamp device 10 is fixed is briefly shown. The lamp device 10 may irradiate light through the opening O opening toward an object (not shown). Alternatively, the lamp device 10 may irradiate light toward a direction that is opposite to the opening O opening toward an object (not shown), and then reflect the irradiated light toward the opening O through the reflective plate (not shown).

The lamp body 100 may be made of Quatz or Borosilicate for efficient transmission of ultraviolet light. The lamp body 100 may be provided in a shape of a cylinder and extend in a direction X-X'. The lamp body 100 may be provided in a shape of a pipe of which both ends are closed.

The lamp body 100 may include a hollow discharge space S therein. As a gas filled in the lamp body 100, a Xenon gas (Xe) or a Xenon mixture gas (Xe, Ar, Ne, etc.) may be used. An inner wall 101' of the lamp body 100 may be coated with a fluorescent substance 102 capable of converting a light-emitting wavelength band (172 nm) of Xenon into a sterilization wavelength band of 250 nm to 260 nm.

In order to implement a lamp of an External Electrode Fluorescent Lamp (EEFL) type, an external electrode may need to be formed on a surface of the lamp body 100. The external electrode may be positioned on an outer surface of the lamp body 100, and extend along the direction X-X' in which the lamp body 100 extends. That is, the external electrode may be provided in a shape of a tape on the surface of the lamp body 100. A material of the external electrode is not limited as long as the material has conductivity. For example, the external electrode may be made of gold, silver, nickel, carbon, gold palladium, silver palladium, platinum, aluminum, or an alloy thereof. The external electrode is also referred to as the band electrodes 400 and 400'.

Referring to FIGS. 5 and 6, the pair of band electrodes 400 and 400' may be provided. The pair of band electrodes 400 and 400' are also referred to as counter electrodes because they are external electrodes arranged opposite to each other. The pair of band electrodes 400 and 400' may have a preset thickness, and be positioned on the surface of the lamp body 100 in such a way as to be opposite to each other. The pair of band electrodes 400 and 400' may be positioned side by side. Because the lamp body 100 is provided in the shape of the cylinder, the pair of band electrodes 400 and 400' may be located respectively at both ends in diameter direction of the lamp body 100.

The lamp body 100 may irradiate light toward an object through the outer surface on which the band electrodes 400 and 400' are not positioned. In other words, light may be irradiated toward an object through an exposed surface 101 of the lamp body 100 between the first band electrode 400 and the second band electrode 400'.

When the pair of band electrodes 400 and 400' are positioned side by side, an angle θ of the exposed surface 101 of the lamp body 100 with respect to a center of a cross section of the lamp body 100 may be about 90° to 120°.

A plurality of cap electrodes may be provided and fixed to both ends of the lamp body 100. The cap electrodes may be in a shape of a cylinder corresponding to the outer surface of the lamp body 100 and including a hollow space.

Referring to FIG. 6, two cap electrodes 200 and 200' may be provided with respect to a lamp body 100. That is, the cap electrodes may be provided as a first cap electrode 200 and a second cap electrode 200'. A material of the cap electrodes is not limited as long as the material has conductivity. The cap electrodes may be made of gold, silver, nickel, carbon, gold palladium, silver palladium, platinum, aluminum, or an alloy thereof.

The first cap electrode 200 may be fixed to a first end 100*a* of the lamp body in the direction X-X'. The second cap electrode 200' may be fixed to a second end 100*b* of the lamp body in the direction X-X'.

Because the plurality of cap electrodes have the same function and similar structures, the first cap electrode 200 will be described below.

The first cap electrode 200 may be provided in a shape of a cylinder including a hollow space in which a first end of the lamp body 100 is inserted. The first cap electrode 200 may have a shape of which both sides open. In a first side 201 of the first cap electrode 200, which is opposite to a second side 202 of the first cap electrode 200 and in which a first end of the lamp body 100 is inserted, a restricting protrusion 204*a* may be formed. The restricting protrusion 204*a* may protrude toward an inside in radial direction of the first cap electrode 200 from an edge of the first cap electrode 200 to prevent a first end of the lamp body 100 from passing through the first side of the first cap electrode 200 and thus protruding out of the first cap electrode 200. A plurality of restricting protrusions 204*a* may be provided (see FIGS. 8 and 9, FIGS. 17 and 18, and FIGS. 20 and 21).

On the other hand, only the second side 202 of the first cap electrode 200 in which a first end of the lamp body 100 is inserted may be open, and the first side 201 may be closed such that a first end of the lamp body 100 is not exposed out of the first cap electrode 200 (see FIGS. 11 to 16).

The first cap electrode 200 may be electrically connected to the first band electrode 400. The first cap electrode 200 may be electrically connected to a first end of the first band electrode 400. An inner side surface of the first cap electrode 200 may be in contact with the first band electrode 400 and be fixed to a first end 100*a* of the lamp body. The first cap electrode 200 may be electrically connected to only the first band electrode 400.

The second cap electrode 200' may be electrically connected to the second band electrode 400'. The second cap electrode 200' may be electrically connected to a first end of the second band electrode 400'. An inner side surface of the second cap electrode 200' may be in contact with the second band electrode 400' and be fixed to a second end 100*b* of the lamp body. The second cap electrode 200' may be electrically connected to only the second band electrode 400'.

The first cap electrode 200 may be electrically connected to only the first band electrode 400, and the second cap electrode 200' may be electrically connected to the second band electrode 400'. Therefore, the first cap electrode 200 may be spaced from the second end of the second band electrode 400'. Likewise, the second cap electrode 200' may be spaced from the second end of the first band electrode 400. That is, the first cap electrode 200 connected to the spring holder 500 which will be described below may apply a voltage only to the first band electrode 400, and the second cap electrode 200' connected to the spring holder 500 may apply a voltage only to the second band electrode 400'.

The spring holders 500 may be coupled with the cap electrodes 200 and 200' in such a way as to be electrically connected to the cap electrodes 200 and 200'. A material of the spring holders 500 is not limited as long as the material has conductivity. For example, the spring holders 500 may be made of gold, silver, nickel, carbon, gold palladium, silver palladium, platinum, aluminum, or an alloy thereof. The spring holders 500 may be connected to an inverter (not shown) and applied a voltage.

A plurality of spring holders 500 may be provided to correspond to the number of the cap electrodes. For example, when two cap electrodes, that is, the first cap electrode 200 and the second cap electrode 200' are fixed to both ends of the lamp body 100, two spring holders 500 may be provided to correspond to the number of the cap electrodes. However, the number of the spring holders 500 is not limited to this.

Because the plurality of spring holders 500 having the same function and similar shapes are provided, the spring holder 500 that is coupled with the first cap electrode 200 will be described below.

The spring holder 500 may include a first fixing part 510 supporting the first side 201 of the first cap electrode 200, a second fixing part 520 supporting a second side 202 of the first cap electrode 200, and an inserting opening 540 formed between a first end of the first fixing part 510 and a first end of the second fixing part 520. The spring holder 500 may be in a shape of a cylinder of which a side opens in a circumferential direction. More specifically, the first fixing part 510 and the second fixing part 520 may be in a shape of a cylinder of which a side opens in the circumferential direction.

Because the first fixing part 510 supports the first side 201 of the first cap electrode 200, the first fixing part 510 may have a shape corresponding to the first side 201 of the first cap electrode 200. The first fixing part 510 may have a shape corresponding to a curved side surface of a cylinder shape. The first fixing part 510 may be substantially in a shape of an arch.

Because the second fixing part 520 supports the second side 202 of the first cap electrode 200, the second fixing part 520 may have a shape corresponding to the second side 202 of the first cap electrode 200. The second fixing part 520 may have a shape corresponding to a curved side surface of a cylinder shape. The second fixing part 520 may be substantially in a shape of an arch.

The spring holder 500 may clamp the first cap electrode 200 by the first fixing part 510 and the second fixing part 520.

The inserting opening 540 may be formed between a first end 510*a* of the first fixing part 510 and a first end 520*a* of the second fixing part 520. The first fixing part 510 and the second fixing part 520 may be in a shape of a cylinder of which a side opens in the circumferential direction. The side opening in the circumferential direction may be provided as the inserting opening 540. The inserting opening 540 may be formed by a first end of the first fixing part 510 positioned to one side of the side opening in the circumferential direction and a first end of the second fixing part 520 positioned to the other side of the side opening in the circumferential direction.

In the first end 510*a* of the first fixing part forming the inserting opening 540, a first guide part 511 extending from the first fixing part 510 may be provided. Likewise, in the first end 520*a* of the second fixing part forming the inserting opening 540, a second guide part 521 extending from the second fixing part 520 may be provided. A width of the first guide part 511 may correspond to a width of the first fixing part 510. A width of the second guide part 521 may correspond to a width of the second fixing part 520.

The first guide part 511 may start from the first end 510*a* of the first fixing part and extend in a direction that is away from the first end 520*a* of the second fixing part. In other words, referring to FIG. 9, when the first end 510*a* of the first fixing part is located at the origin of a coordinate system, the first guide part 511 may start from the first end 510*a* of the first fixing part and extend toward a Y'Z plane.

The second guide part 521 may start from the first end 520*a* of the second fixing part and extend in a direction that is away from the first end 510*a* of the first fixing part. In other words, referring to FIG. 9, when the first end 520*a* of the second fixing part is located at the origin of a coordinate system, the second guide part 521 may start from the first end 520*a* of the second fixing part and extend toward a YZ plane.

A distance between an inclined surface of the first guide part 511 and an inclined surface of the second guide part 521 may increase outward in the radial direction. By this structure, the first cap electrode 200 may be easily inserted into the inserting opening 540.

The spring holder 500 may further include a supporting portion 530 to which the second end 510*b* of the first fixing part and the second end 520*b* of the second fixing part are fixed.

The supporting portion 530 may be provided in a shape of a plate. As seen in FIGS. 1 to 6, the supporting portion 530 may have a structure in which a portion of a plate shape is curved according to a frame shape of a home appliance in which the lamp device 10 is installed. The supporting portion 530 may include a fixing hole 531 for fixing the supporting portion 530 to the frame of the home appliance.

Referring to FIG. 2, the first cap electrode 200 and the second cap electrode 200' fixed to both ends of the lamp body 100 may pass through the inserting openings 540 of the spring holders 500, respectively, in an insertion direction D1, and be then rested inside the spring holders 500. Referring to FIG. 1, in the state in which the first cap electrode 200 and the second cap electrode 200' are respectively fixed to the corresponding spring holders 500, the lamp body 100 may irradiate light toward an object through the outer surface of the lamp body 100 on which the band electrodes 400 and 400' are not positioned. In other words, light may be irradiated toward an object through the exposed surface 101 of the lamp body, exposed between the first band electrode 400 and the second band electrode 400'.

However, in a case in which the spring holder 500 clamps the first cap electrode 200 only by the first fixing part 510 and the second fixing part 520, an intensity of light arriving at an object may be reduced when the exposed surface 101 fails to exactly face the object due to an external force.

FIG. 7 is a result table obtained by measuring intensities of light according to directions in which the exposed surface 101 faces when a voltage is applied by an inverter of 4W to a UVC lamp in which a diameter of the lamp body 100 is 5 mm, an extension length of the lamp body 100 is 13 cm, the thickness of the band electrodes 400 and 400' is 2.5 mm, and an angle of a circumference formed by the exposed surface 101 is 120°. A distance between the lamp body 100 and an object is maintained at 2 cm.

More specifically, 0°, 30°, 60°, and 90° in an upper part of the table mean angles formed by a direction in which the exposed surface 101 faces and radial directions toward a center of the inserting opening 540 from the center of the cross section of the lamp body 100. For convenience of description, it is assumed that an object is placed on a straight line connecting the center of the cross section of the lamp body 100 to the center of the inserting opening 540. Also, in FIG. 6, no cap electrodes are shown, and only the pair of band electrodes 400 and 400' and the spring holders 500 are shown.

It is seen from FIG. 7 that, when the exposed surface 101 exactly faces the object, light has a highest intensity, and, as the exposed surface 101 deviates from the object according to a rotation of the lamp body 100 without facing the object, the intensity of light is gradually reduced.

Accordingly, there is a need for causing the exposed surface 101 to exactly face an object regardless of an installation process or an installation state. Also, there is a need for causing the exposed surface 101 to exactly face an object without a rotation of the lamp body 100 fixed to the spring holder 500 by an external force. For this, a structure for causing the first cap electrode 200 to interfere with the spring holder 500 may be added. The structure will be described in detail below.

Figure 8:
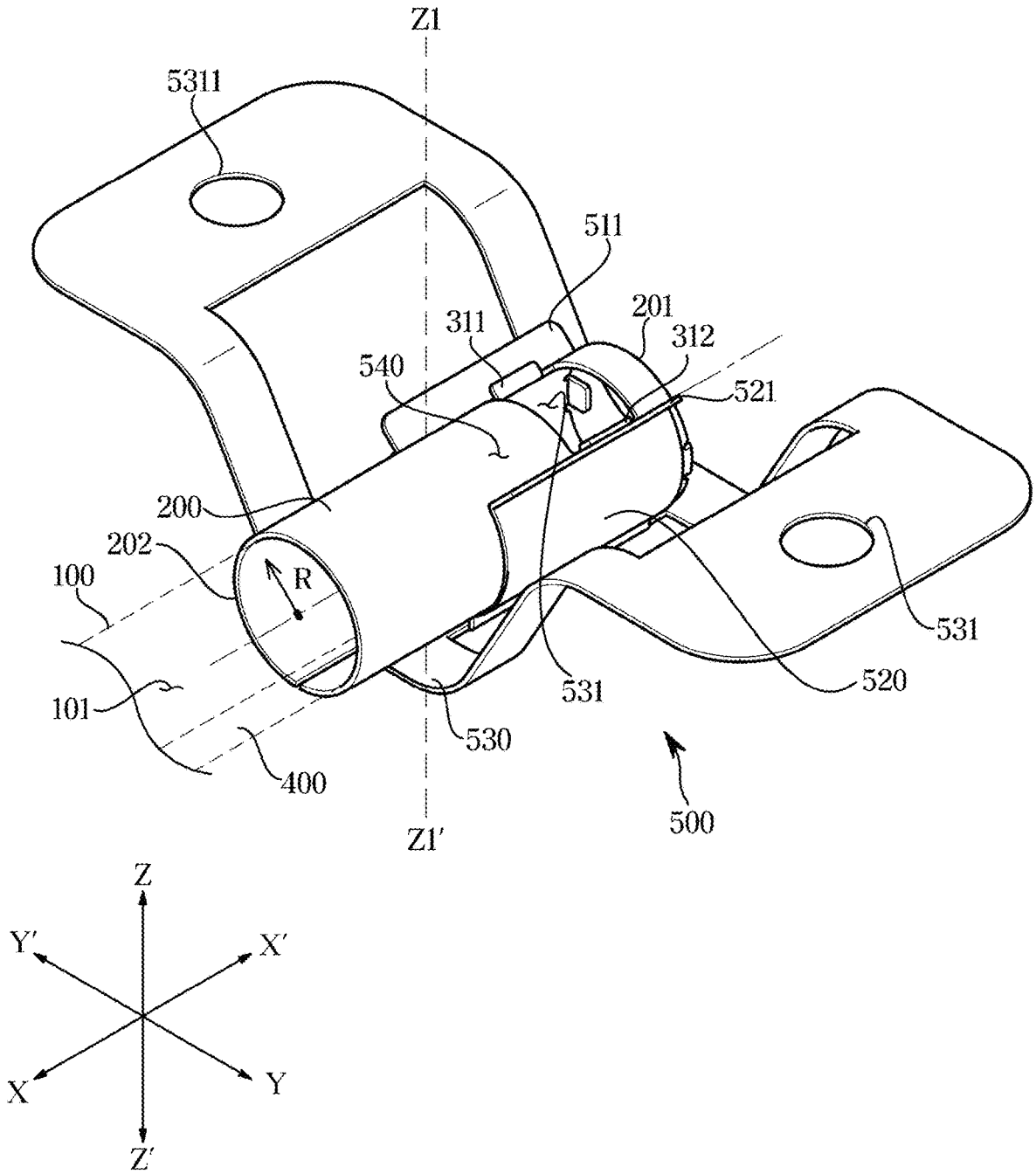
FIG. 8 is a perspective view showing a coupled state of a spring holder and a cap electrode in a lamp device according to an embodiment of the disclosure.
Figure 9:
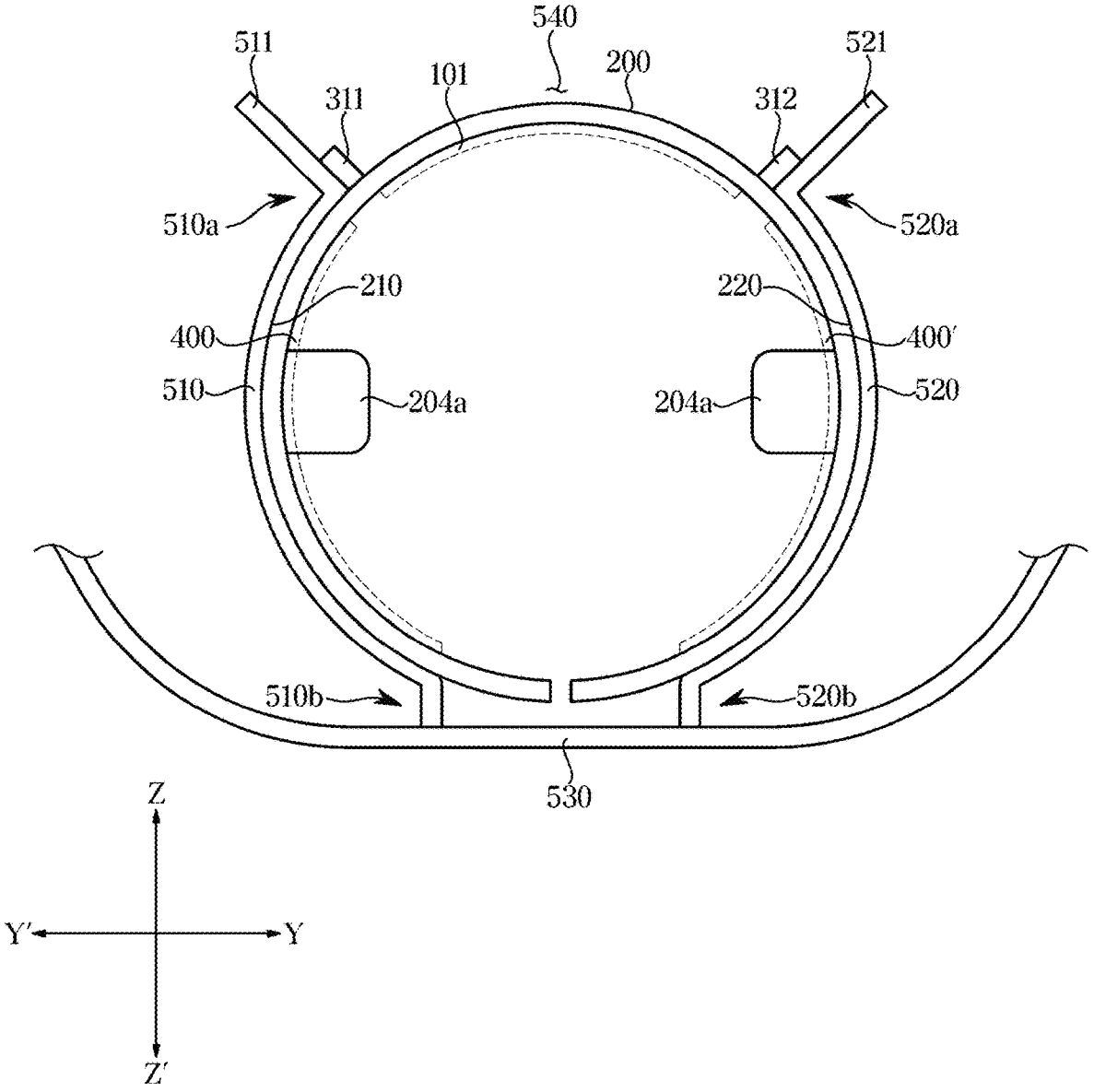
FIG. 9 shows the coupled state of the spring holder and the cap electrode in an X' direction of FIG. 8.
Figure 10:
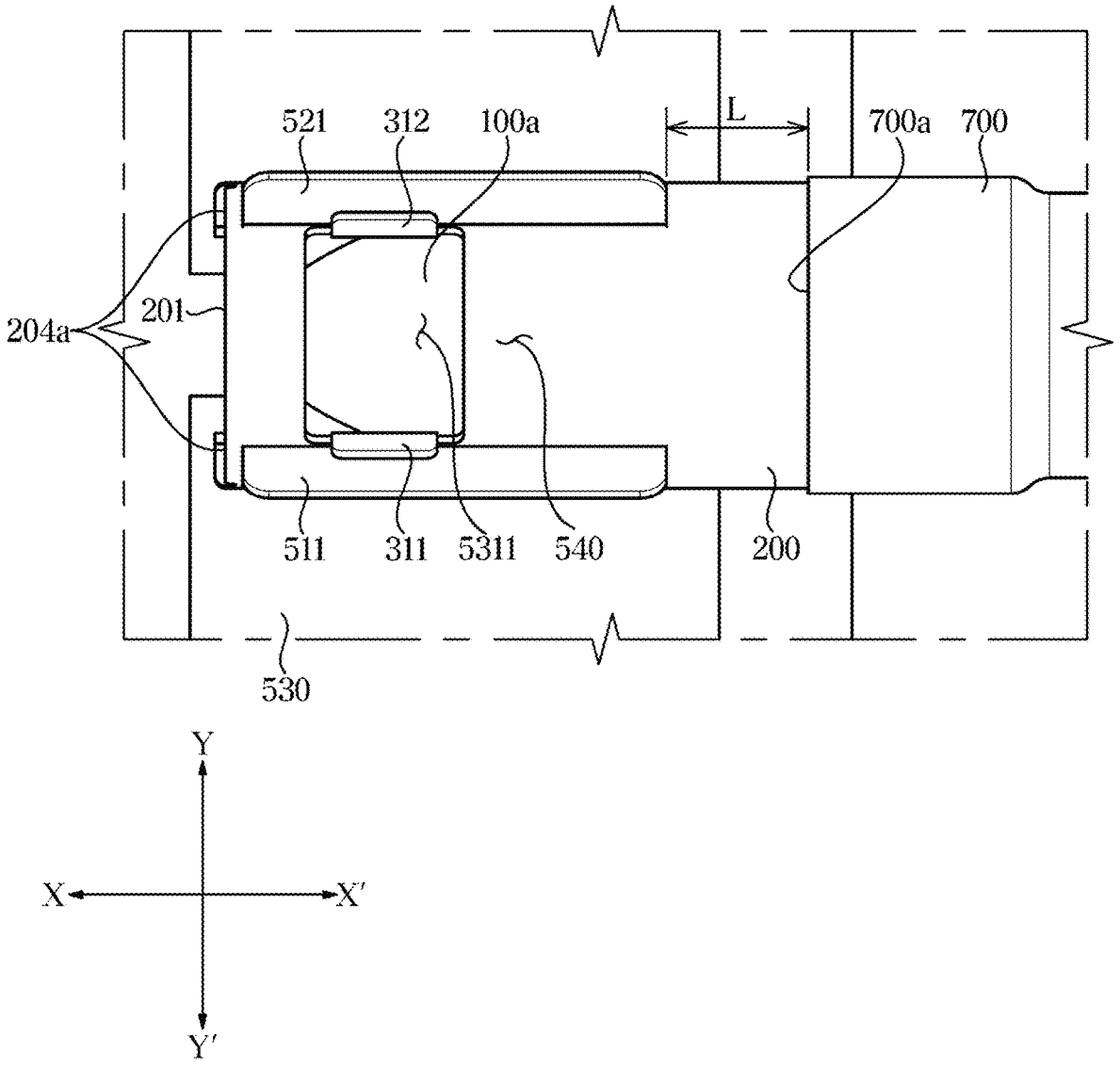
FIG. 10 shows the coupled state of the spring holder and the cap electrode in a Z' direction of FIG. 8.

FIG. 8 is a perspective view showing a coupled state of a spring holder and a cap electrode in a lamp device according to an embodiment of the disclosure. FIG. 9 shows the coupled state of the spring holder and the cap electrode in an X' direction of FIG. 8. FIG. 10 shows the coupled state of the spring holder and the cap electrode in a Z' direction of FIG. 8.

As a structure for causing the first cap electrode 200 to interfere with the spring holder 500, stoppers 311 and 312 protruding from an outer surface of the first cap electrode 200 may be provided. Referring to FIG. 8, the stoppers 311 and 312 may protrude from the outer surface of the first cap electrode 200. The stoppers 311 and 312 may protrude from the outer surface of the first cap electrode 200 outward in a radial direction R. The stoppers 311 and 312 may include a first stopper 311 supported by the first fixing part 510, and a second stopper 312 supported by the second fixing part 520.

The first stopper 311 may be supported by the first fixing part 510, and extend in the same direction as the first guide part 511. The second stopper 312 may be supported by the second fixing part 520, and extend in the same direction as the second guide part 521. The first stopper 311 or the second stopper 312 may be in a shape of a plate protruding outward in a radial direction of the first cap electrode 200.

In the first cap electrode 200, an opening 5311 may be formed between the first stopper 311 and the second stopper 312 along a circumference of the first cap electrode 200. The outside of the first cap electrode 200 may communicate with the inside of the first cap electrode 200 through the opening 5311. Because the opening 5311 is formed, heat generated between the lamp body 100 and the first cap electrode 200 may be effectively discharged to the outside. However, the shape of the first cap electrode 200 is not limited to this, and the first cap electrode 200 may have a closed shape without including the opening 5311.

As described above, the inserting opening 540 may be formed by the first end 510*a* of the first fixing part and the first end 520*a* of the second fixing part. A distance between the first stopper 311 and the second stopper 312 may correspond to a distance between the first end 510*a* of the first fixing part and the first end 520*a* of the second fixing part.

In order to align the exposed surface 101 of the lamp body 100, exposed between the first band electrode 400 and the second band electrode 400', with the inserting opening 540, the first stopper 311 and the second stopper 312 may respectively interfere with the first end 510*a* of the first fixing part and the first end 520*a* of the second fixing part of the spring holder 500.

A protrusion width of the first stopper 311 may be narrower than that of the first end of the first fixing part 510, and a protrusion width of the second stopper 312 may be narrower than that of the first end of the second fixing part 520. However, the protrusion width of the first stopper 311 or the protrusion width of the second stopper 312 is not limited to this, and the protrusion widths of the first stopper 311 and the second stopper 312 may be the same as or wider than those of the corresponding fixing parts.

The exposed surface 101 of the lamp body 100, exposed between the first band electrode 400 and the second band electrode 400', may be aligned with the inserting opening 540. Because the first stopper 311 interferes with the first end 510*a* of the first fixing part, and the second stopper 312 interferes with the first end 520*a* of the second fixing part, the first stopper 311 and the second stopper 312 may restrict a rotation in circumferential direction of the first cap electrode 200. Through this structure, the lamp body 100 fixed to the spring holder 500 may not rotate by an external force, and the exposed surface 101 may exactly face an object.

Referring to FIG. 10, the lamp device may further include a shatter-resistant film 700 surrounding a part of the lamp body 100 and a part of the first cap electrode 200. The shatter-resistant film 700 may be provided as a tube of a fluoroplastic material having corrosion resistance and high bursting strength. The shatter-resistant film 700 may be finished by contracting it by heat and then adhering it onto the outer surface of the lamp body 100.

One end 700*a* of the shatter-resistant film 700 may be spaced a distance L from the spring holder 500. A distance L between the one end 700*a* of the shatter-resistant film 700 and the spring holder 500 may be 0.1 mm or more.

Because the one end 700*a* of the shatter-resistant film 700 is spaced from the spring holder 500, a spark by discharge that may be caused when the one end 700*a* of the shatter-resistant film 700 is in contact with the spring holder 500 may be prevented.

Figure 11:
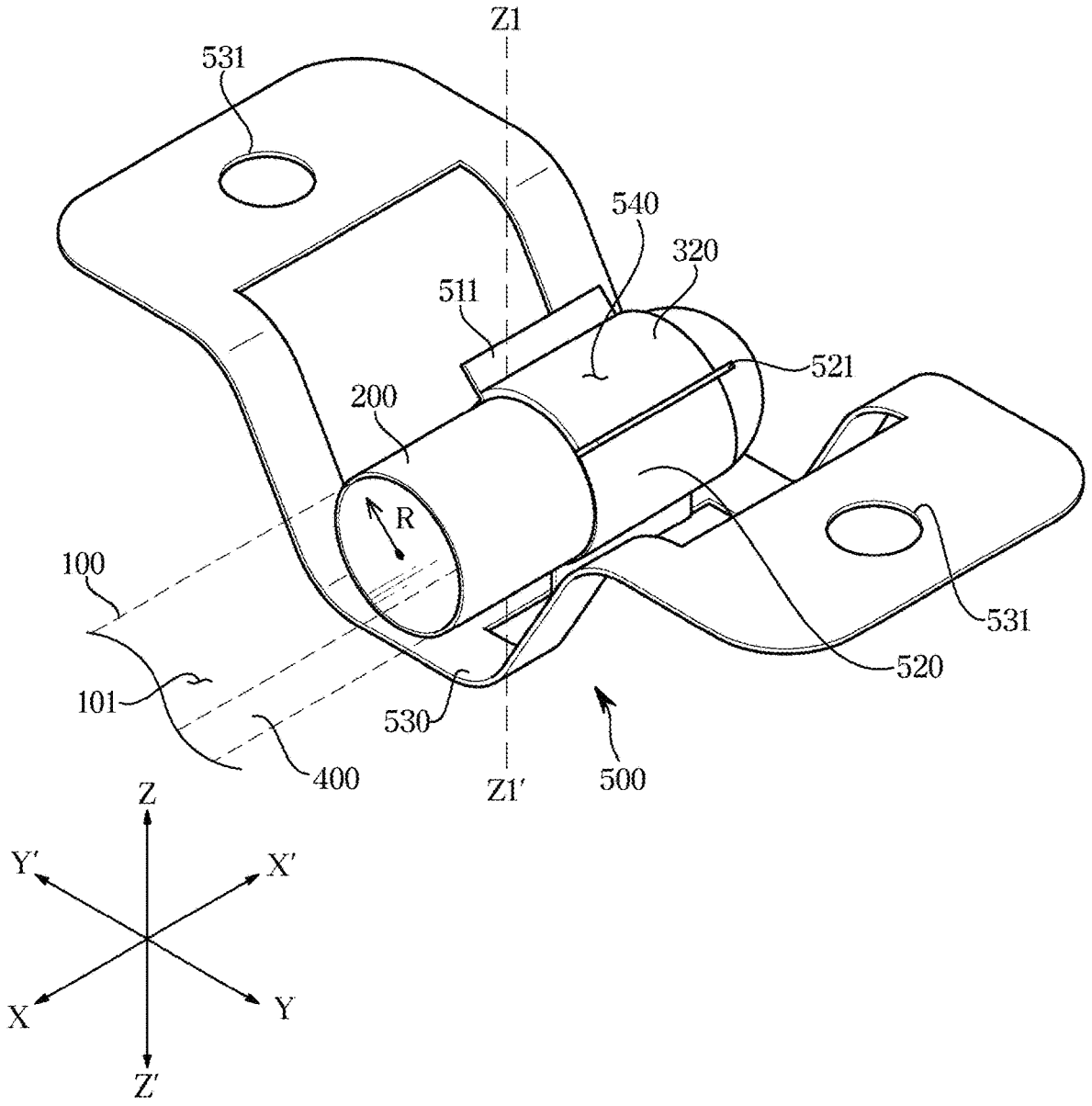
FIG. 11 is a perspective view showing a coupled state of a spring holder and a cap electrode in a lamp device according to another embodiment of the disclosure.
Figure 12:
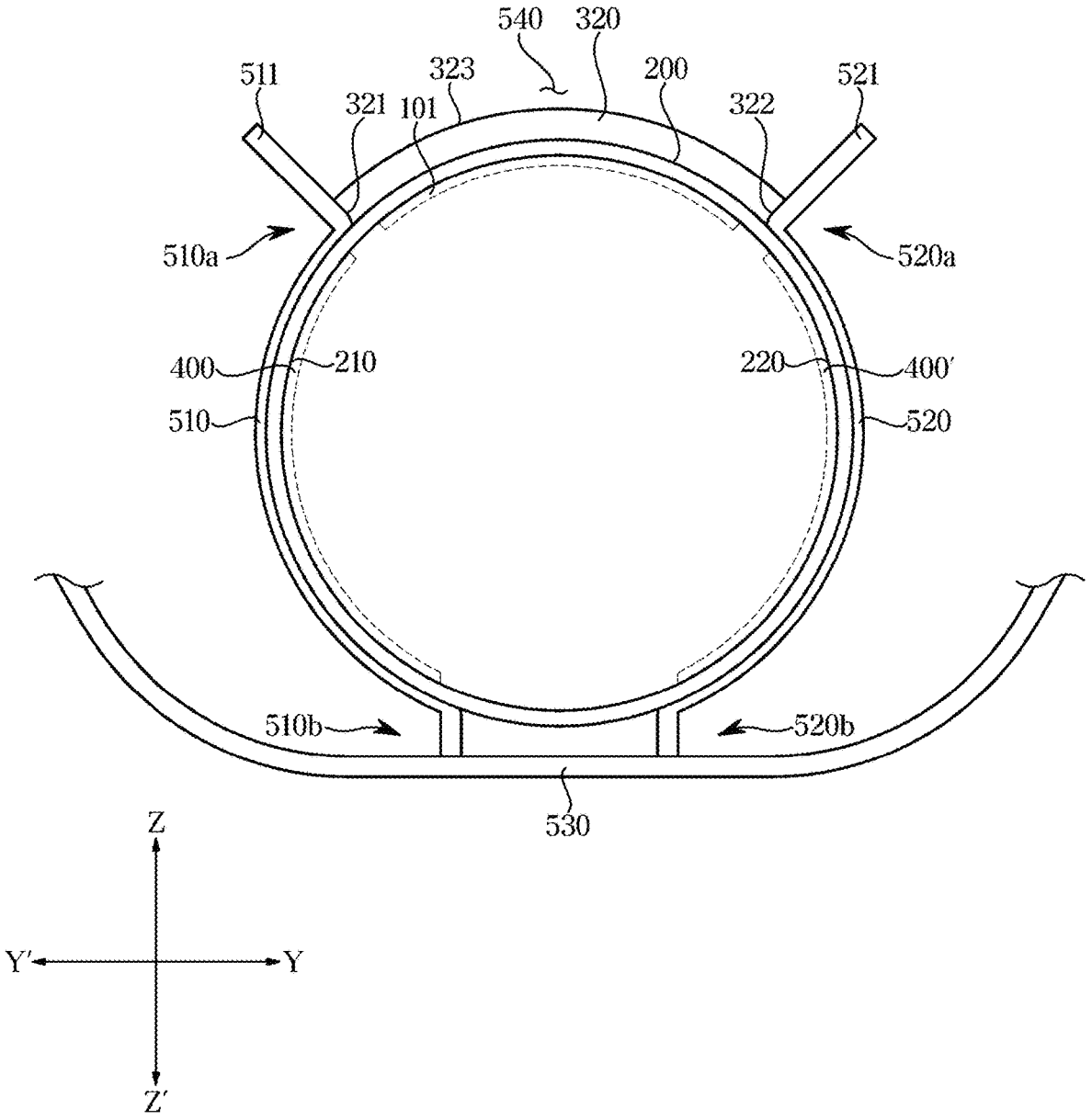
FIG. 12 shows the coupled state of the spring holder and the cap electrode in an X' direction of FIG. 11.

FIG. 11 is a perspective view showing a coupled state of a spring holder and a cap electrode in a lamp device according to another embodiment of the disclosure. FIG. 12 shows the coupled state of the spring holder and the cap electrode in an X' direction of FIG. 11.

The same reference numerals of FIGS. 11 and 12 as those of FIGS. 1 to 10 represent like components that perform like functions. Hereinafter, descriptions about the same configurations are omitted, and the following descriptions will be given based on configurations having differences. Also, the cap electrodes may be provided as the first cap electrode 200 and the second cap electrode 200', as described above, and the following descriptions will be given based on the first cap electrode 200.

In the lamp device according to another embodiment of the disclosure, as shown in FIGS. 11 and 12, as a structure in which the first cap electrode 200 is interfered by the spring holder 500, a stopper 320 protruding from the outer surface of the first cap electrode 200 may be provided.

The stopper 320 may protrude from the outer surface of the first cap electrode 200 to include a first surface 321 interfering with the first end 510*a* of the first fixing part, a second surface 322 interfering with the first end 520*a* of the second fixing part, and a connecting surface 323 connecting the first surface 321 to the second surface 322 and extending along the circumferential direction of the first cap electrode 200.

The stopper 320 may be provided substantially in a shape of an arch along the outer surface of the first cap electrode 200. The stopper 320 provided in the shape of the arch may be positioned between the first end 510*a* of the first fixing part and the first end 520*a* of the second fixing part, and have a shape corresponding to the inserting opening 540. A protrusion height in radial direction of the stopper 320 may be lower than an extension length of the first guide part 511 or the second guide part 521.

The exposed surface 101 of the lamp body 100, exposed between the first band electrode 400 and the second band electrode 400', may be aligned with the inserting opening 540. Because the first surface 321 of the stopper 320 is interfered by a first end of the first fixing part 510, and the second surface 322 of the stopper 320 is interfered by a first end of the second fixing part 520, the stopper 320 may restrict a rotation in circumferential direction of the first cap electrode 200. Through this structure, the lamp body 100 fixed to the spring holder 500 may not rotate by an external force, and the exposed surface 101 may exactly face an object.

Also, the stopper 320 may have structural stiffness compared with the first stopper 311 or the second stopper 312 shown in FIGS. 8 to 10.

Figure 13:
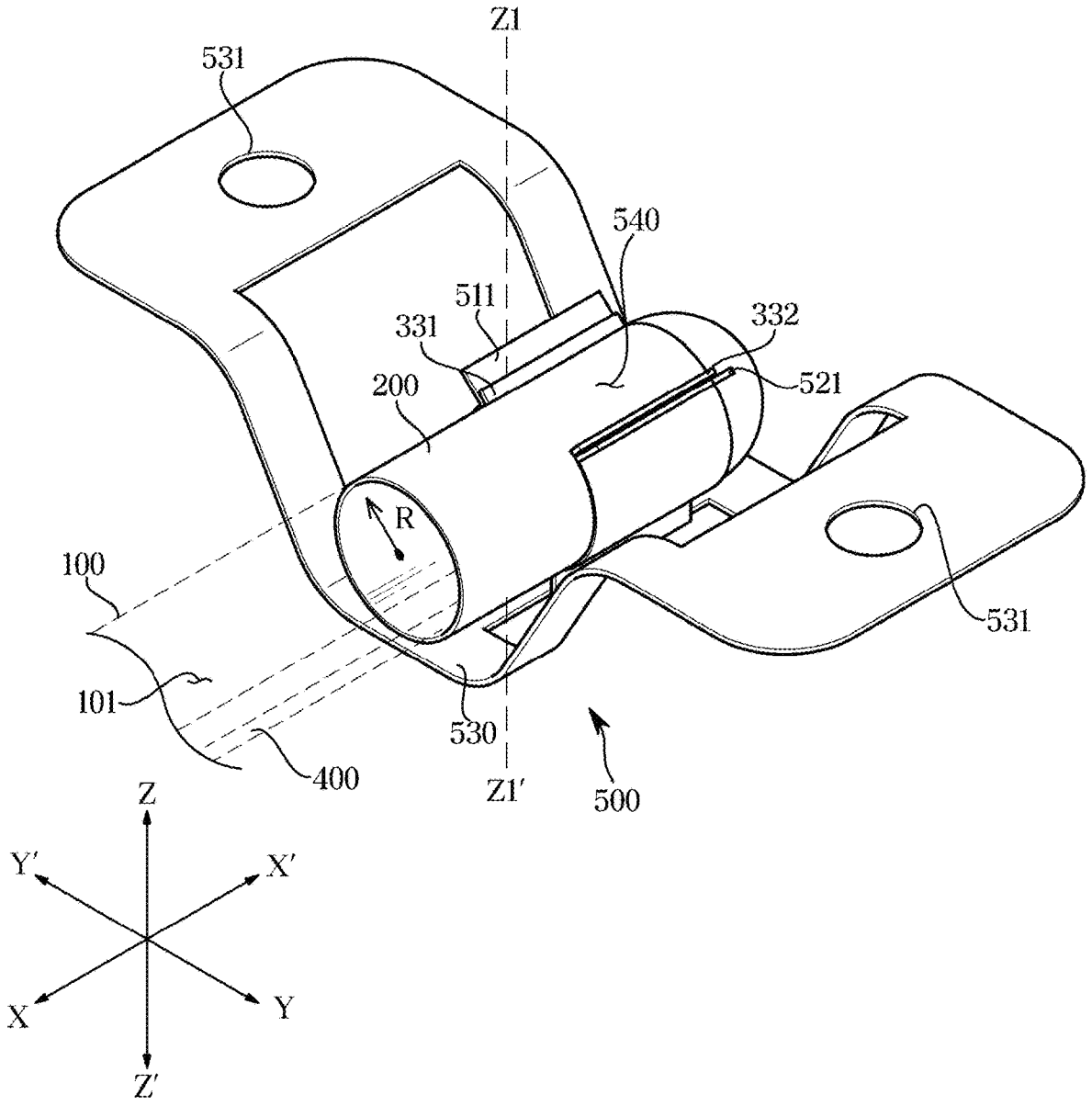
FIG. 13 is a perspective view showing a coupled state of a spring holder and a cap electrode in a lamp device according to another embodiment of the disclosure.
Figure 14:
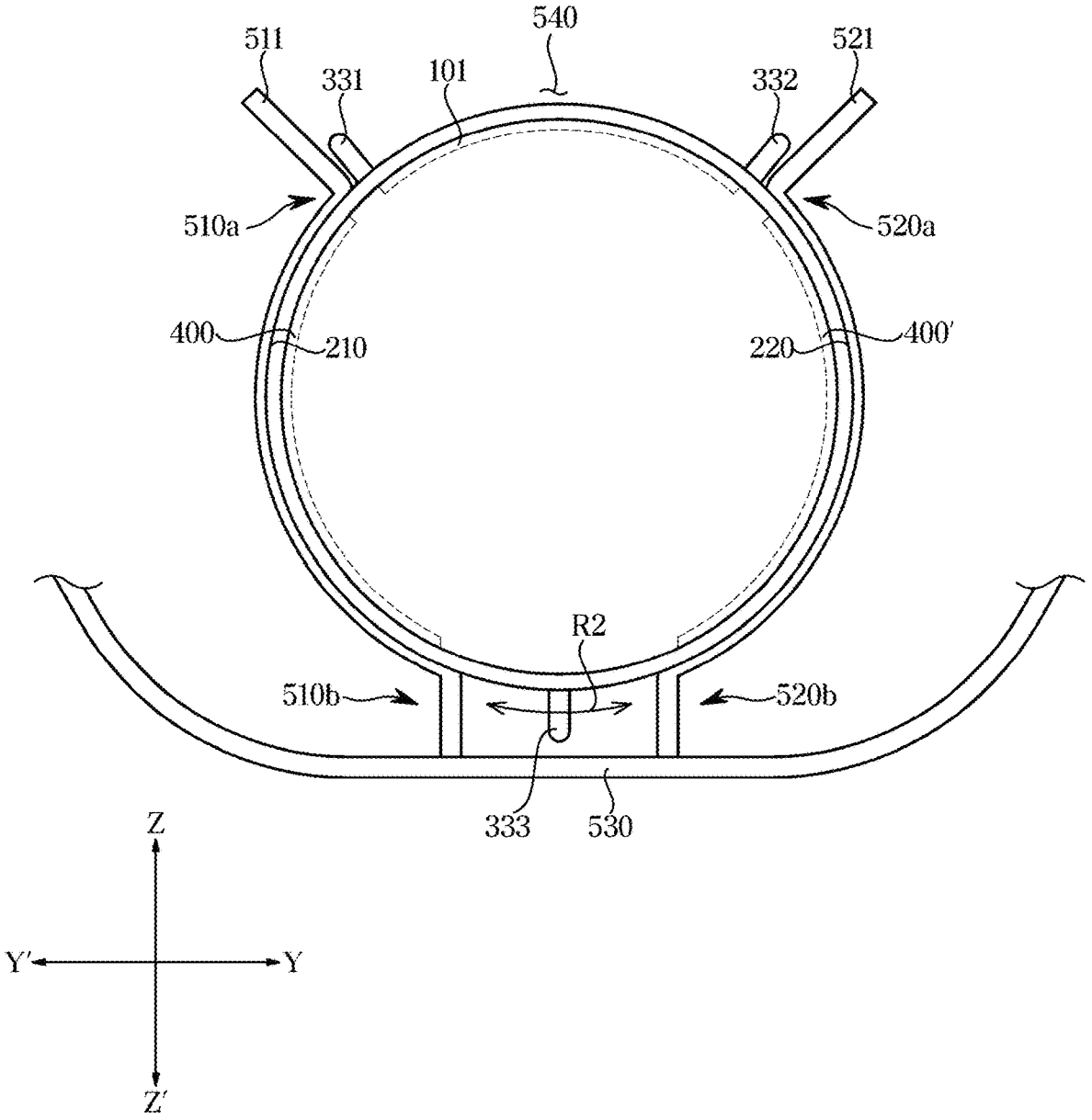
FIG. 14 shows the coupled state of the spring holder and the cap electrode in an X' direction of FIG. 13.

FIG. 13 is a perspective view showing a coupled state of a spring holder and a cap electrode in a lamp device according to another embodiment of the disclosure. FIG. 14 shows the coupled state of the spring holder and the cap electrode in an X' direction of FIG. 13.

The same reference numerals of FIGS. 13 and 14 as those of FIGS. 1 to 10 represent like components that perform like functions.

Hereinafter, descriptions about the same configurations are omitted, and the following descriptions will be given based on configurations having differences. Also, the cap electrodes may be provided as the first cap electrode 200 and the second cap electrode 200', as described above, and the following descriptions will be given based on the first cap electrode 200.

In the lamp device according to another embodiment of the disclosure, as shown in FIGS. 13 and 14, as a structure in which the first cap electrode 200 is interfered by the spring holder 500, stoppers 331, 332, and 333 protruding from the outer surface of the first cap electrode 200 may be provided.

Referring to FIGS. 13 and 14, a first stopper 331 and a second stopper 332 may be respectively similar to the first stopper 311 and the second stopper 312 shown in FIGS. 8 to 10.

A third stopper 333 may protrude outward in the radial direction from the first cap electrode 200. However, the third stopper 333 may protrude outward in the radial direction toward the supporting portion 530, unlike the first stopper 331 or the second stopper 332. The third stopper 333 may protrude between the second end 510*b* of the first fixing part and the second end 520*b* of the second fixing part.

When the first stopper 331 or the second stopper 332 is fragmented by an external force, the first cap electrode 200 may rotate in the radial direction R2, so that the exposed surface 101 of the lamp body 100, exposed between the first band electrode 400 and the second band electrode 400', may be not aligned with the inserting opening 540. In other words, the exposed surface 101 of the lamp body 100 may not exactly face an object.

The third stopper 333 may cause, even when the first stopper 331 or the second stopper 332 is fragmented by an external force so that the lamp body 100 rotates, the lamp body 100 to be caught by any one of the first fixing part 510 or the second fixing part 520. More specifically, when the lamp body 100 rotates, the lamp body 100 may be caught by any one of the second end 510*b* of the first fixing part or the second end 520*b* of the second fixing part. Accordingly, the exposed surface 101 may stably face an object.

Figure 15:
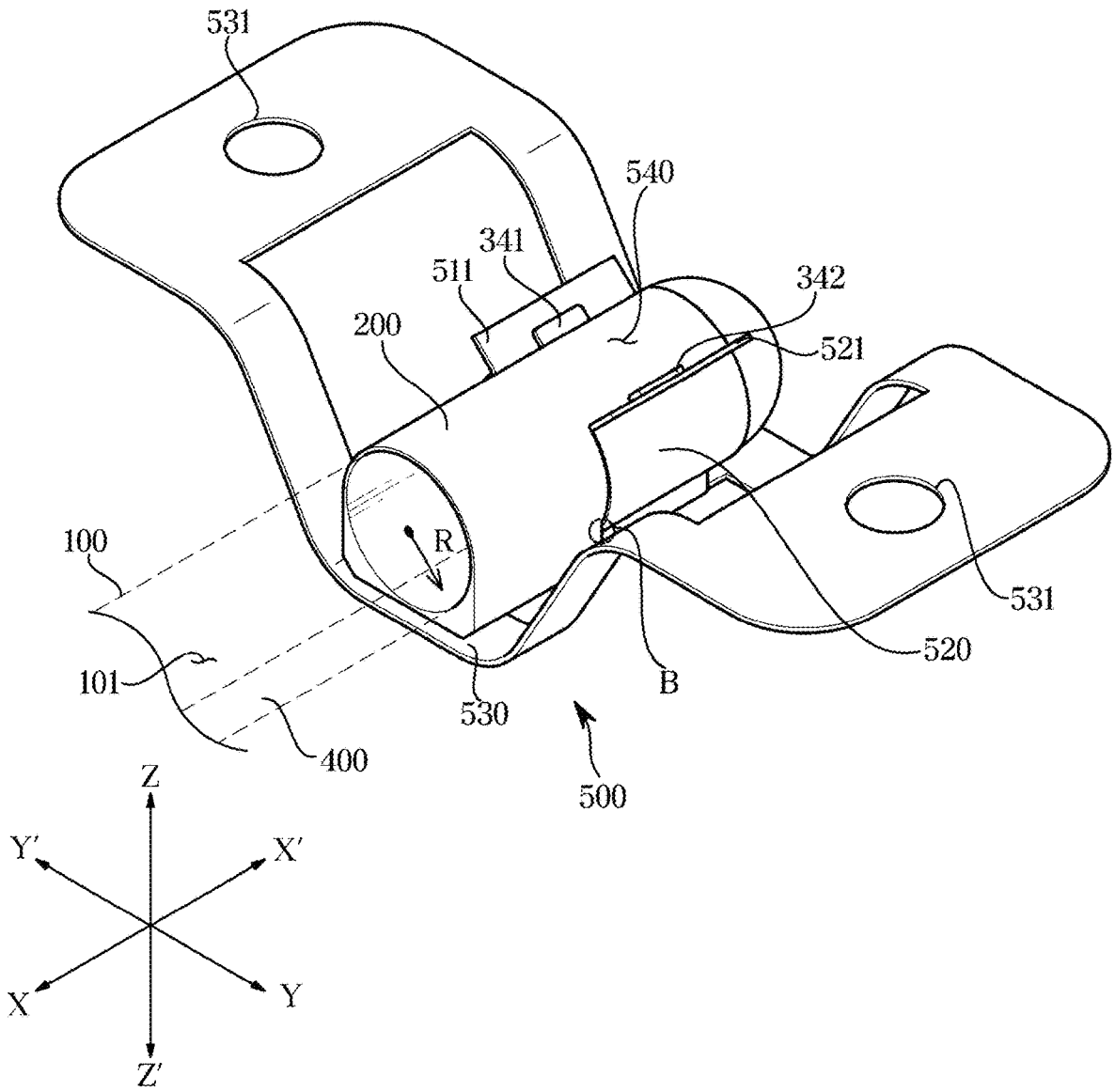
FIG. 15 is a perspective view showing a coupled state of a spring holder and a cap electrode in a lamp device according to another embodiment of the disclosure.
Figure 16:
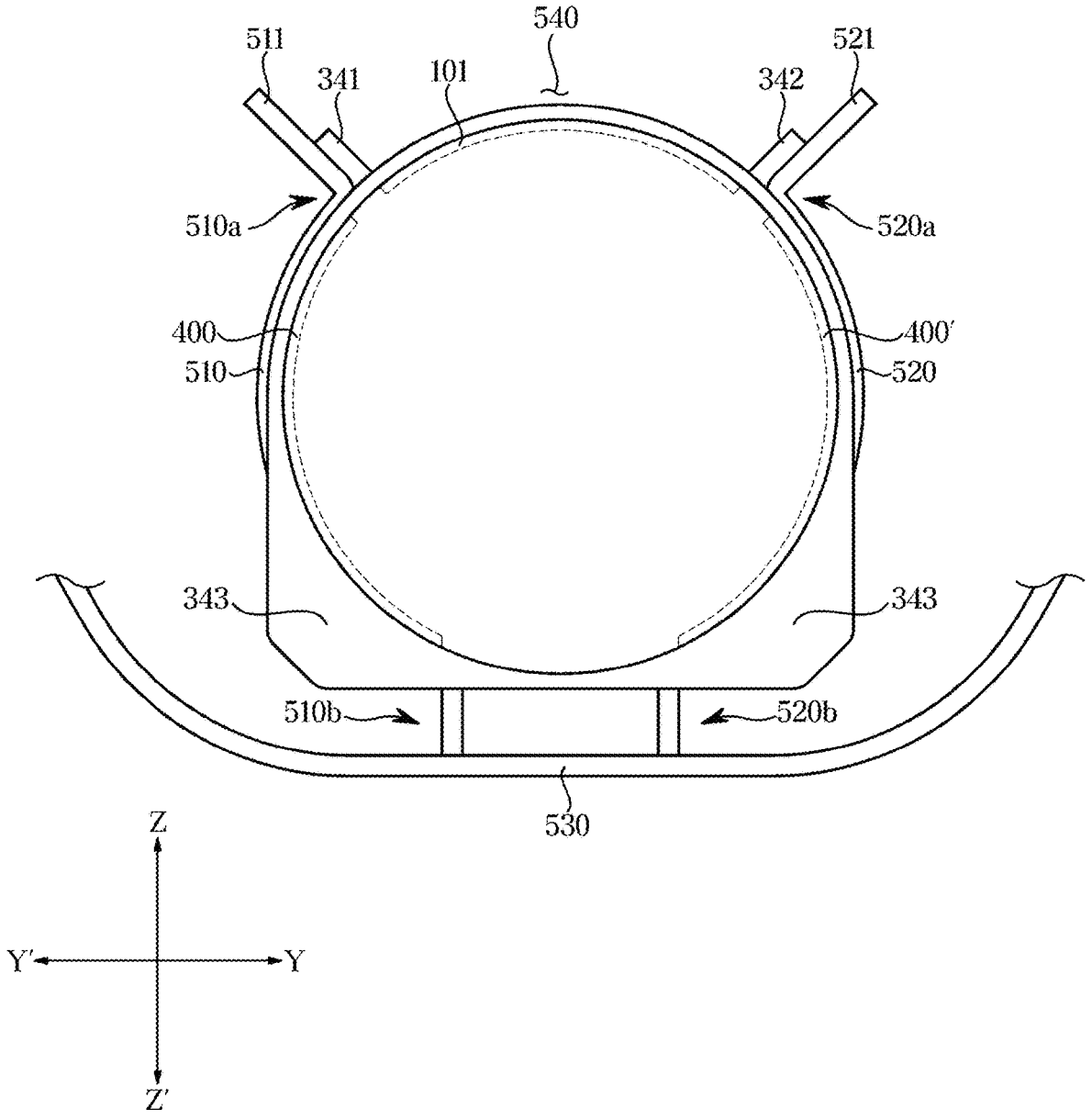
FIG. 16 shows the coupled state of the spring holder and the cap electrode in an X' direction of FIG. 15.

FIG. 15 is a perspective view showing a coupled state of a spring holder and a cap electrode in a lamp device according to another embodiment of the disclosure. FIG. 16 shows the coupled state of the spring holder and the cap electrode in an X' direction of FIG. 15.

The same reference numerals of FIGS. 15 and 16 as those of FIGS. 1 to 10 represent like components that perform like functions.

Hereinafter, descriptions about the same configurations are omitted, and the following descriptions will be given based on configurations having differences. Also, the cap electrodes may be provided as the first cap electrode 200 and the second cap electrode 200', as described above, and the following descriptions will be given based on the first cap electrode 200.

In the lamp device according to another embodiment of the disclosure, as shown in FIGS. 15 and 16, as a structure in which the first cap electrode 200 is interfered by the spring holder 500, stoppers 341 and 342 and a movement preventing portion 343 protruding from the outer surface of the first cap electrode 200 may be provided.

Referring to FIGS. 15 and 16, the first stopper 341 and the second stopper 342 may be respectively similar to the first stopper 311 and the second stopper 312 shown in FIGS. 8 to 10.

The movement preventing portion 343 may protrude from the first cap electrode 200 and be interfered (see a B area of FIG. 15) by a first end of the spring holder 500 located on an inner side of the lamp body 100 in the extension direction of the lamp body 100 to restrict the lamp body 100 from moving in the extension direction.

The movement preventing portion 343 may protrude from the outer surface of the first cap electrode 200 to be caught by the body of the first fixing part 510 and the second end 510*b* of the first fixing part. Alternatively, the movement preventing portion 343 may protrude from the outer surface of the first cap electrode 200 to be caught by the body of the second fixing part 520 and the second end 520*b* of the second fixing part. The first cap electrode 200 may have substantially a D shape due to the protruding movement preventing portion 343 when seen in the X' direction.

The movement preventing portion 343 may protrude toward the supporting portion 530, unlike the stopper 320 of the lamp device according to the other embodiment of the disclosure as shown in FIGS. 11 and 12.

More specifically, in the case in which the movement preventing portion 343 is caught by the body of the first fixing part 510 and the second end 510*b* of the first fixing part, the movement preventing portion 343 may protrude toward a Z'Y' plane from the outer surface of the first cap electrode 200 when it is assumed that a center of the cap electrode 200 is located at the origin of the coordinate system. In the case in which the movement preventing portion 343 is caught by the body of the second fixing part 520 and the second end 520*b* of the second fixing part, the movement preventing portion 343 may protrude toward a Z'Y plane from the outer surface of the first cap electrode 200 when it is assumed that the center of the cap electrode 200 is located at the origin of the coordinate system.

The lamp body 100 may be restricted from moving in the extension direction by the movement preventing portion 343 described above. Even when the first stopper 341 or the second stopper 342 is fragmented by an external force so that the lamp body 100 rotates, the movement preventing portion 343 may be interfered by the supporting portion 530 to cause the exposed surface 101 of the lamp body 100, exposed between the first band electrode 400 and the second band electrode 400', to stably face an object.

Figure 17:
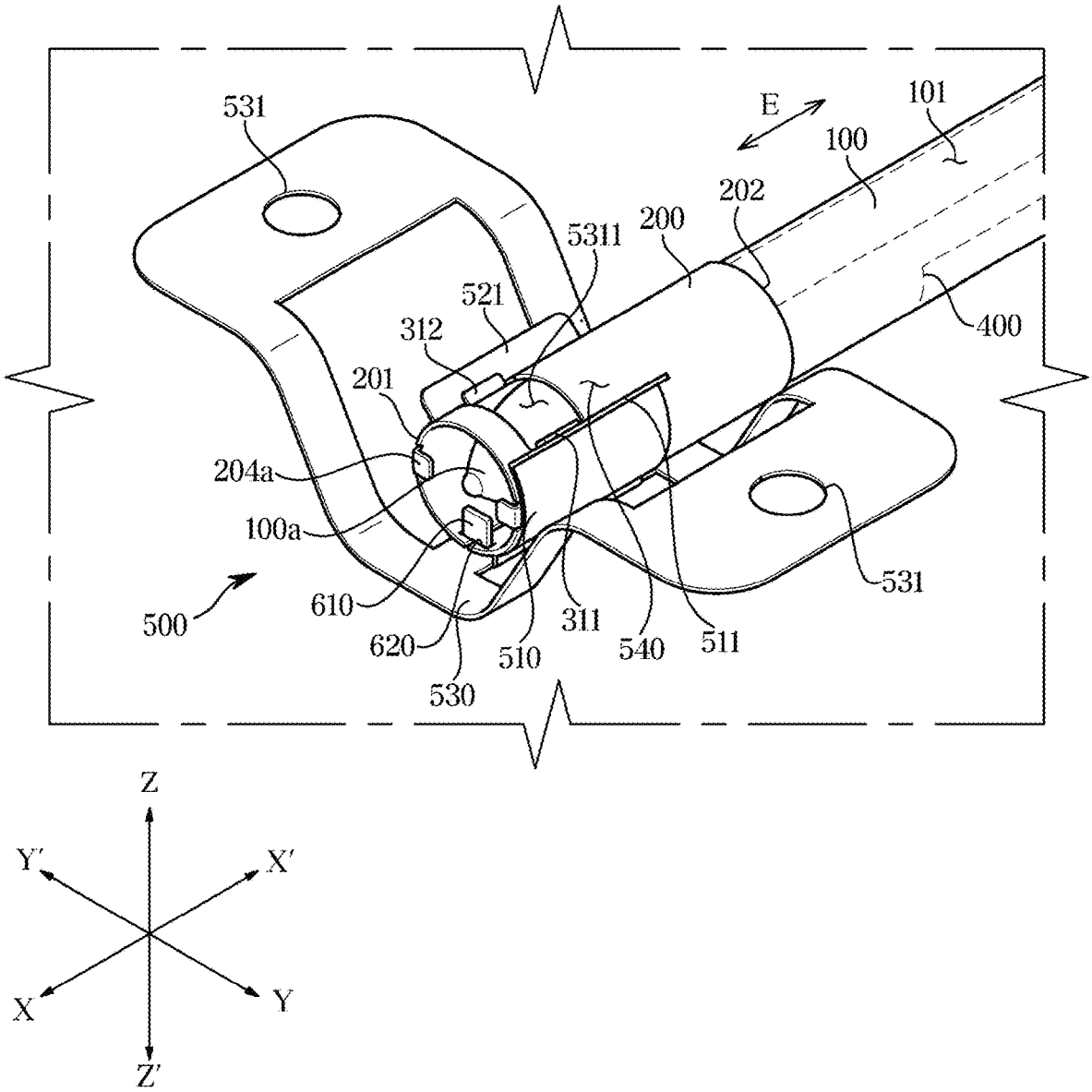
FIG. 17 is a perspective view showing a coupled state of a spring holder and a cap electrode in a lamp device according to another embodiment of the disclosure.
Figure 18:
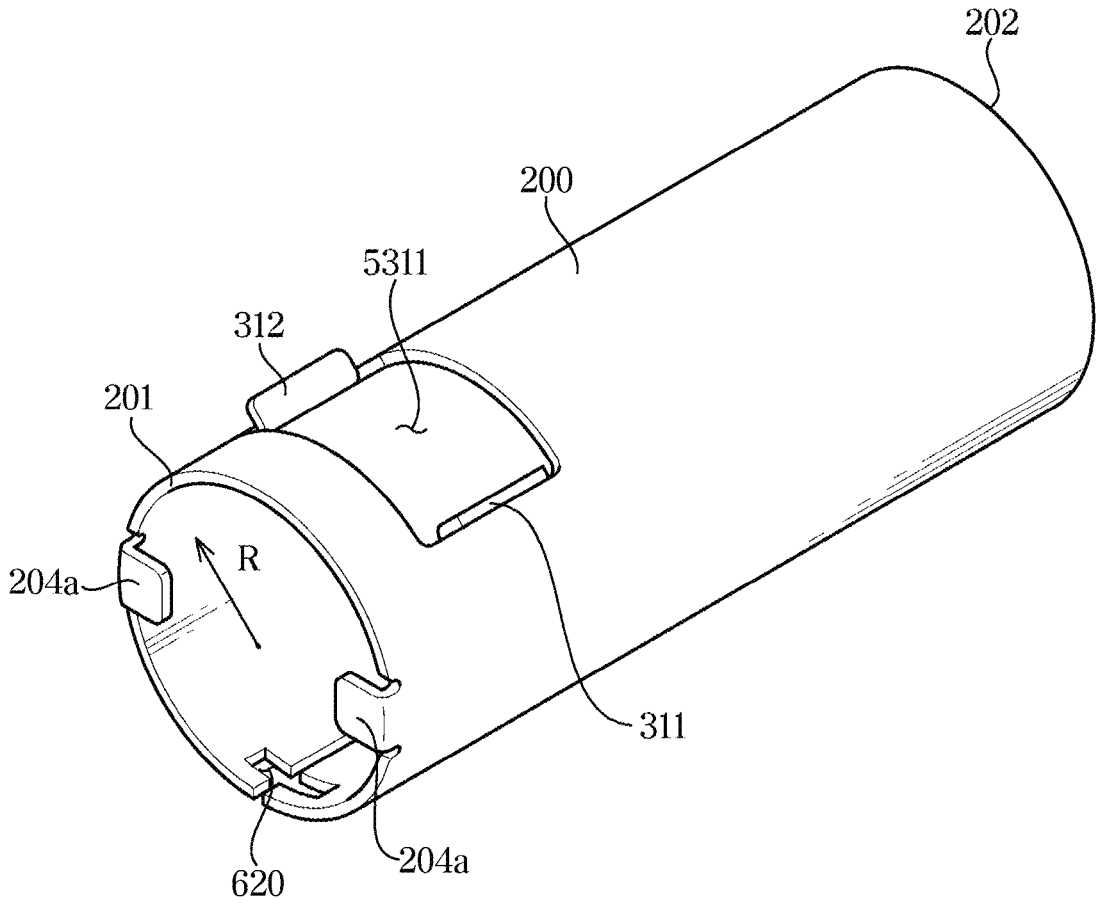
FIG. 18 is a perspective view of the cap electrode of FIG. 17.
Figure 19:
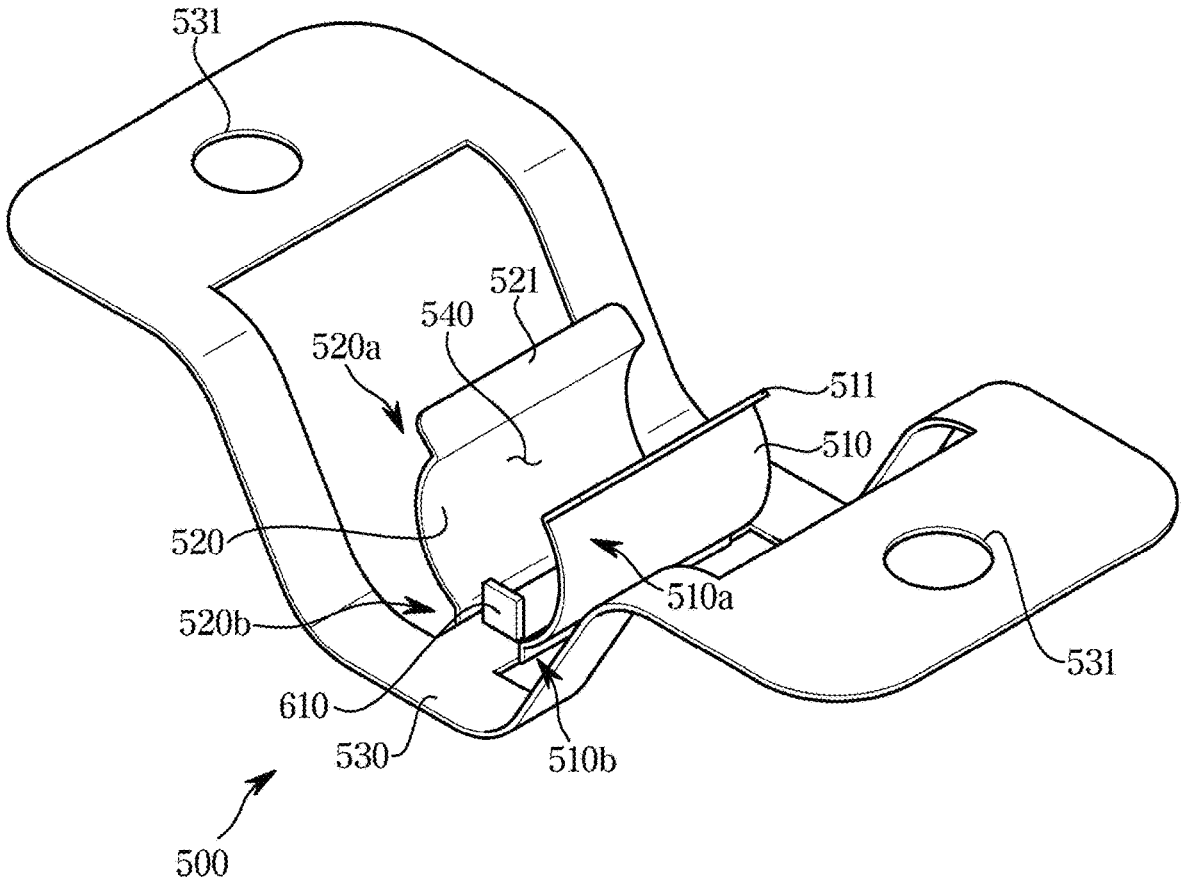
FIG. 19 is a perspective view of the spring holder of FIG. 17.

FIG. 17 is a perspective view showing a coupled state of a spring holder and a cap electrode in a lamp device according to another embodiment of the disclosure. FIG. 18 is a perspective view of the cap electrode of FIG. 17. FIG. 19 is a perspective view of the spring holder of FIG. 17.

The same reference numerals of FIGS. 17 to 19 as those of FIGS. 1 to 10 represent like components that perform like functions. Hereinafter, descriptions about the same configurations are omitted, and the following descriptions will be given based on configurations having differences. Also, the cap electrodes may be provided as the first cap electrode 200 and the second cap electrode 200', as described above, and the following descriptions will be given based on the first cap electrode 200. The supporting portion 530 may include a fixing protrusion 610 protruding toward the first cap electrode 200 from the supporting portion 530. The first cap electrode 200 may further include a fixing hole 620 corresponding to the fixing protrusion 610.

The fixing protrusion 610 may be positioned between the second end 510*b* of the first fixing part and the second end 520*b* of the second fixing part. The fixing hole 620 may be adjacent to the first side 201 of the first cap electrode 200. The fixing protrusion 610 may be inserted in the fixing hole 620 and fixed.

The fixing protrusion 610 may be inserted in the fixing hole 620 to prevent the first cap electrode 200, that is, the lamp body 100 from rotating in the circumferential direction, together with the first stopper 311 and the second stopper 312. Also, the fixing protrusion 610 may be inserted in the fixing hole 620 to restrict the lamp body 100 from moving in the extension direction.

Through this structure, the lamp body 100 fixed to the spring holder 500 may not rotate by an external force, and the exposed surface 101 may exactly face an object.

Figure 20:
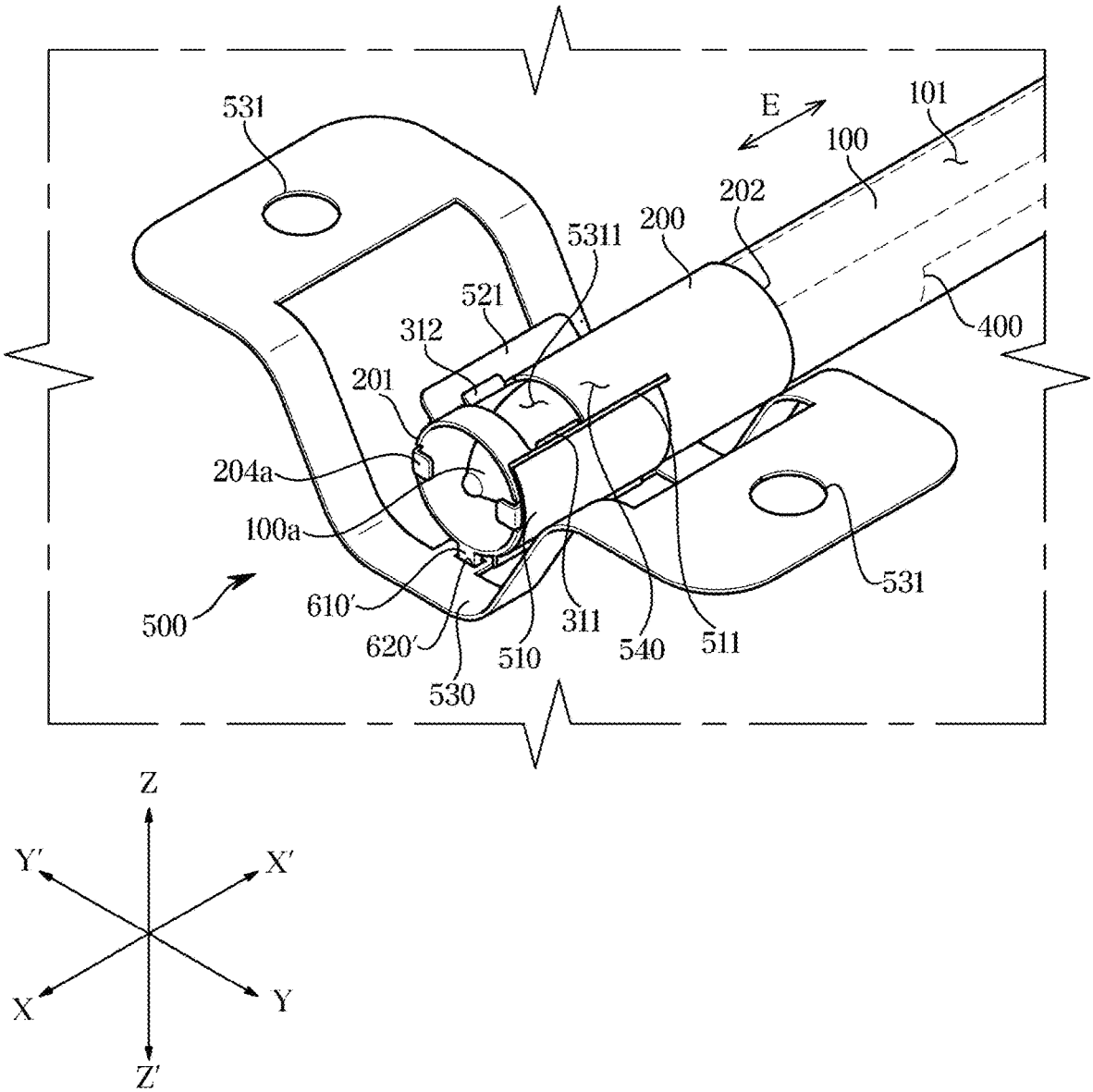
FIG. 20 is a perspective view showing a coupled state of a spring holder and a cap electrode in a lamp device according to another embodiment of the disclosure.
Figure 21:
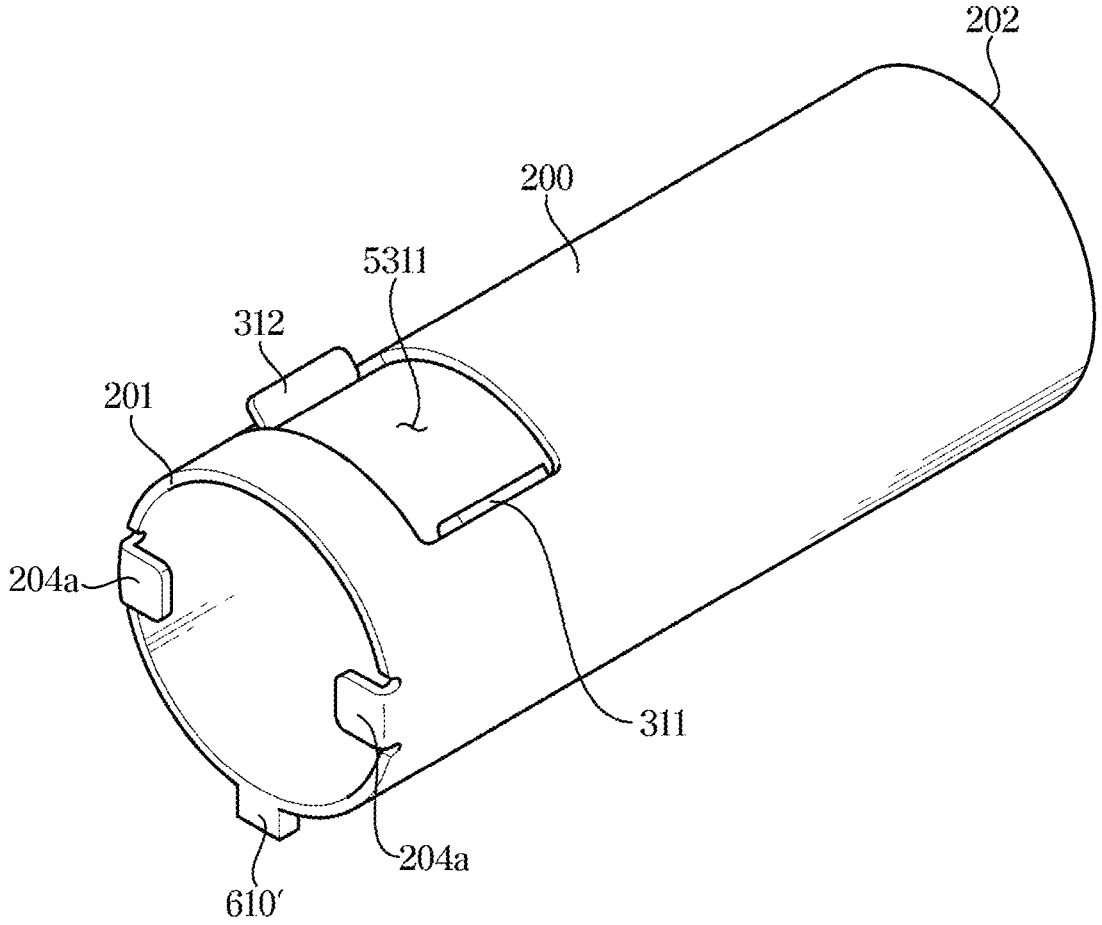
FIG. 21 is a perspective view of the cap electrode of FIG. 20.
Figure 22:
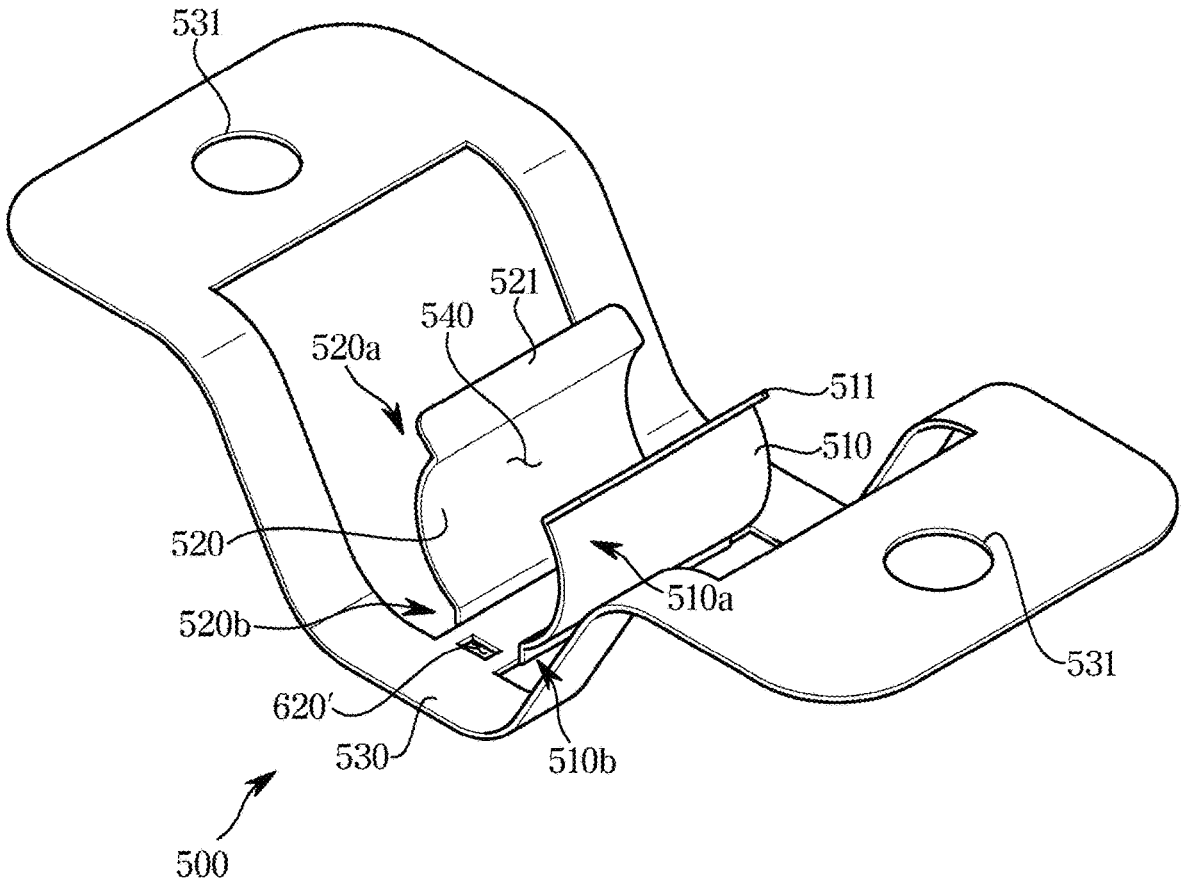
FIG. 22 is a perspective view of the spring holder of FIG. 20.

FIG. 20 is a perspective view showing a coupled state of a spring holder and a cap electrode in a lamp device according to another embodiment of the disclosure. FIG. 21 is a perspective view of the cap electrode of FIG. 20. FIG. 22 is a perspective view of the spring holder of FIG. 20.

The same reference numerals of FIGS. 20 to 22 as those of FIGS. 1 to 10 represent like components that perform like functions. Hereinafter, descriptions about the same configurations are omitted, and the following descriptions will be given based on configurations having differences. Also, the cap electrodes may be provided as the first cap electrode 200 and the second cap electrode 200', as described above, and the following descriptions will be given based on the first cap electrode 200.

The first cap electrode 200 may include a fixing protrusion 610' protruding toward the supporting portion 530. The supporting portion 530 may further include a fixing hole 620' corresponding to the fixing protrusion 610'.

The fixing protrusion 610' may be positioned between the second end 510*b* of the first fixing part and the second end 520*b* of the second fixing part. The fixing hole 620' may be adjacent to the first side 201 of the first cap electrode 200. The fixing protrusion 610' may be inserted in the fixing hole 620' and fixed.

The fixing protrusion 610' may be inserted into the fixing hole 620' to prevent the first cap electrode 200, that is, the lamp body 100 from rotating in the circumferential direction, together with the first stopper 311 and the second stopper 312. Also, the fixing protrusion 610' may be inserted in the fixing hole 620' to restrict the lamp body 100 from moving in the extension direction.

Through this structure, the lamp body 100 fixed to the spring holder 500 may not rotate by an external force, and the exposed surface 101 may exactly face an object.

Figure 23:
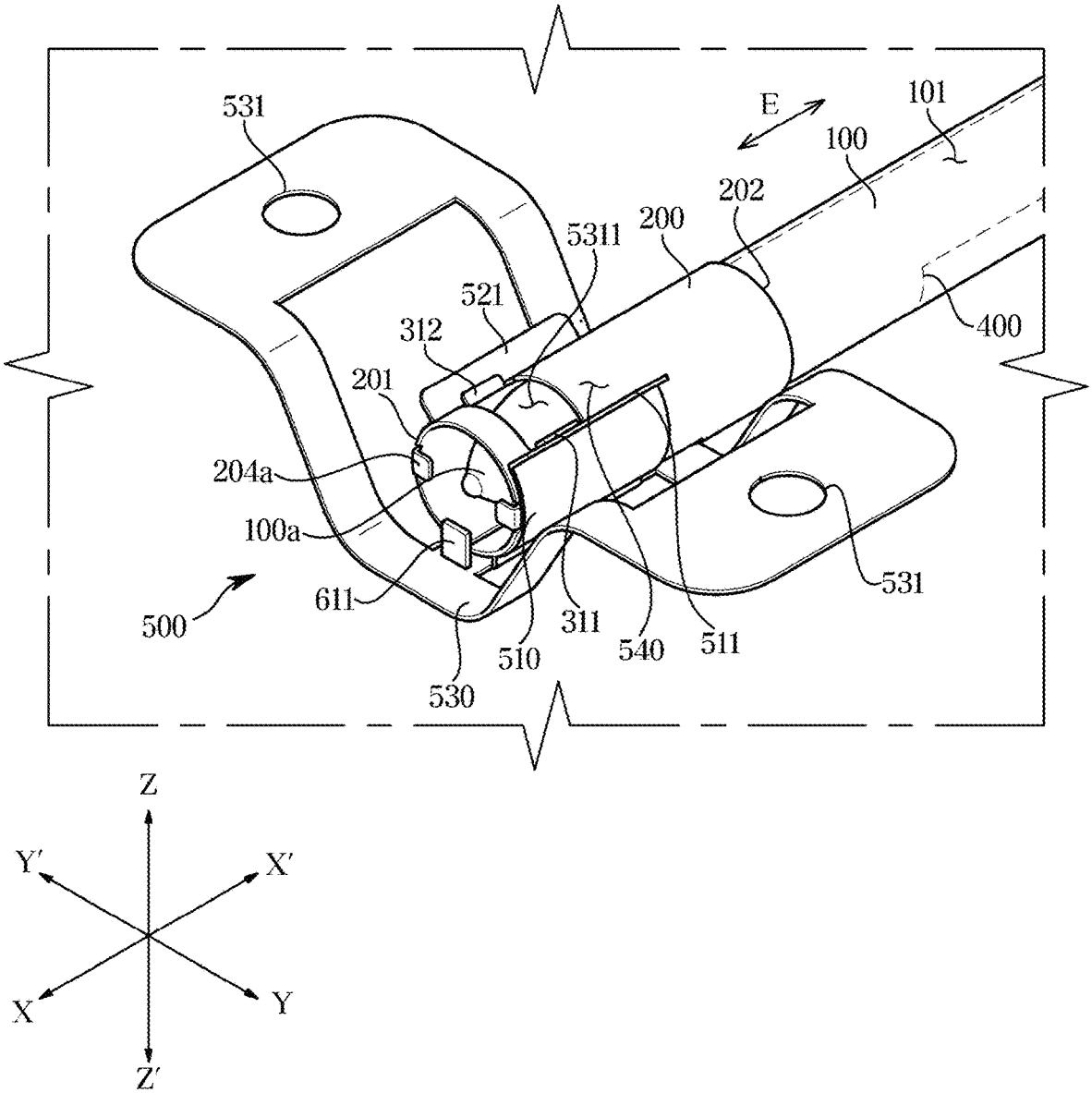
FIG. 23 is a perspective view showing a coupled state of a spring holder and a cap electrode in a lamp device according to another embodiment of the disclosure.
Figure 24:
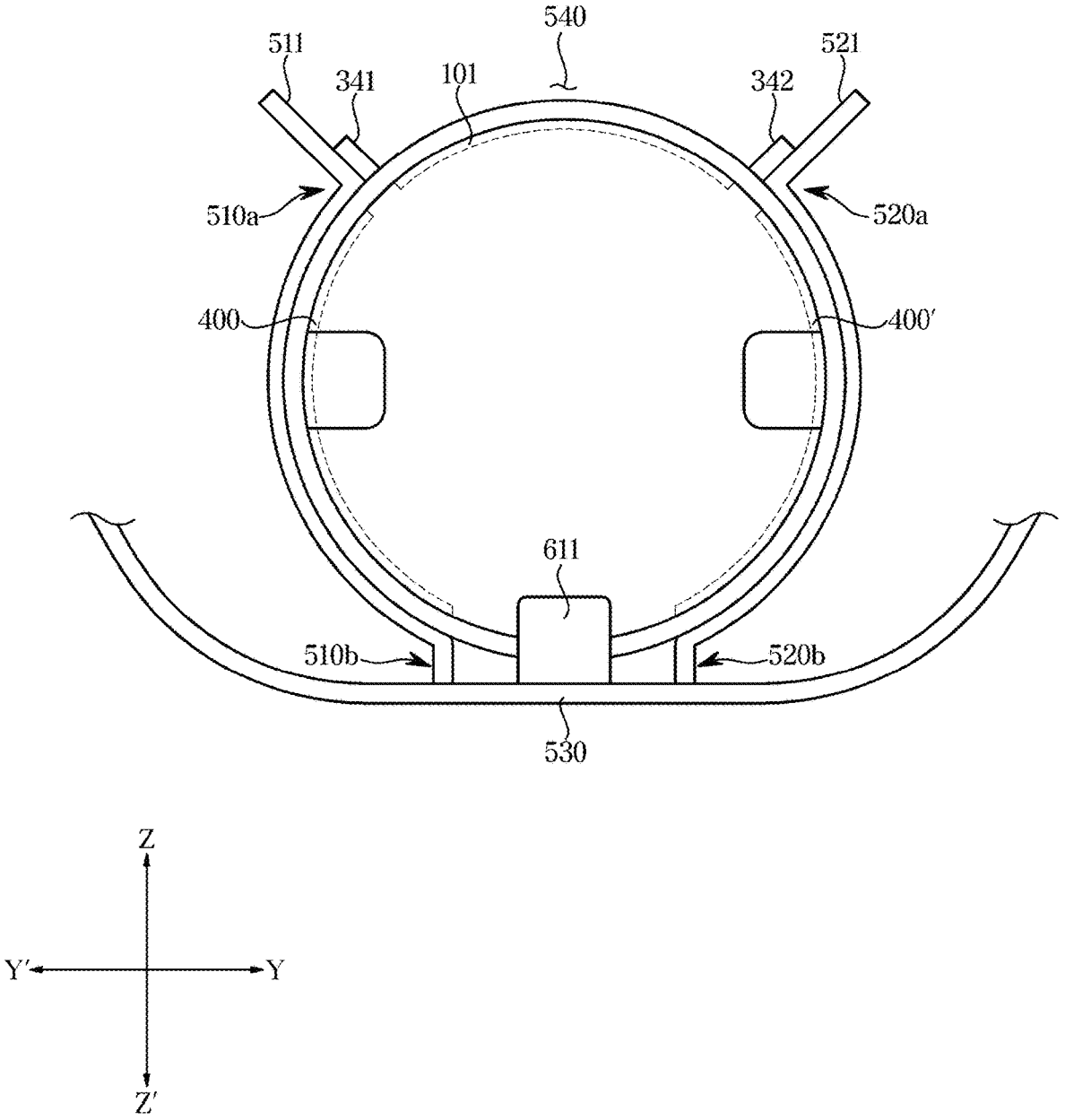
FIG. 24 shows the coupled state of the spring holder and the cap electrode in an X' direction of FIG. 23.

FIG. 23 is a perspective view showing a coupled state of a spring holder and a cap electrode in a lamp device according to another embodiment of the disclosure. FIG. 24 shows the coupled state of the spring holder and the cap electrode in an X' direction of FIG. 23.

The same reference numerals of FIGS. 23 and 24 as those of FIGS. 1 to 10 represent like components that perform like functions. Hereinafter, descriptions about the same configurations are omitted, and the following descriptions will be given based on configurations having differences.

Also, the cap electrodes may be provided as the first cap electrode 200 and the second cap electrode 200', as described above, and the following descriptions will be given based on the first cap electrode 200.

The supporting portion 530 may include a fixing protrusion 611 protruding toward the first cap electrode 200 from the supporting portion 530. The fixing protrusion 611 may be provided substantially in a shape of a rectangular parallelepiped. However, the shape of the fixing protrusion 611 is not limited to this. The fixing protrusion 611 may support the first side 201 of the first cap electrode 200. More specifically, the fixing protrusion 611 may support a part of a circumference of the first side 201 of the first cap electrode 200. The fixing protrusion 611 may support a part being adjacent to the supporting portion 530 in the circumference of the first side 201 of the first cap electrode 200 from an outer side of the lamp body toward an inner side of the lamp body in the extension direction E of the lamp body, that is, in a X' direction.

Through this structure, the lamp body 100 fixed to the spring holder 500 may not rotate by an external force, and the exposed surface 101 may exactly face an object.

Although the present disclosure has been described with various embodiments, various changes and modifications may be suggested to one skilled in the art. It is intended that the present disclosure encompass such changes and modifications as fall within the scope of the appended claims.

What is claimed is:

1. A rare gas lamp device comprising:

a lamp body provided in a shape of a cylinder to contain a rare gas and a fluorescent material for emitting light;

a plurality of cap electrodes fixed to both ends of the lamp body;

a plurality of band electrodes extending in a length direction from the plurality of cap electrodes and arranged opposite to each other with respect to a center axis of the lamp body, and positioned on a circumferential surface of the lamp body, wherein a light-emitting area of the lamp body is an exposed surface of the circumferential surface of the lamp body between the plurality of band electrodes;

a spring holder coupled with each of the plurality of cap electrodes and configured to apply a voltage to the band electrodes through the plurality of cap electrodes, the spring holder including:

a first fixing part configured to support a first side of a cap electrode, a second fixing part configured to support a second side of the cap electrode, and an inserting opening formed between a first end of the first fixing part and a first end of the second fixing part such that the cap electrode is inserted in the inserting opening; and a stopper protruding from each of the plurality of cap electrodes, wherein, when each of the plural of cap electrodes is inserted through the inserting opening, the stopper is interfered by the first end of the first fixing part or the first end of the second fixing part to restrict the light-emitting area from rotating about the center axis of the lamp body.

2. The rare gas lamp device of claim 1, wherein the stopper comprises:

a first stopper supported by the first fixing part, and a second stopper supported by the second fixing part.

3. The rare gas lamp device of claim 2, wherein:

each of the plurality of cap electrodes is in a shape of a cylinder including a hollow space, and the first stopper or the second stopper is in a shape of a plate protruding outward in a radial direction for each of the plurality of cap electrodes.

4. The rare gas lamp device of claim 3, wherein:

the spring holder further comprises a supporting portion to which a second end of the first fixing part and a second end of the second fixing part are fixed, the rare gas lamp device further comprising a third stopper protruding outward in the radial direction of each of the plurality of cap electrodes toward the supporting portion from the cap electrode, and any one of the first fixing part or the second fixing part catches the third stopper when the lamp body rotates.

5. The rare gas lamp device of claim 2, wherein each of the plurality of cap electrodes is in a shape of a cylinder having a hollow space.

6. The rare gas lamp device of claim 1, wherein the stopper protrudes from an outer surface of each of the plurality of cap electrodes to include:

a first surface interfered by the first end of the first fixing part, a second surface interfered by the first end of the second fixing part, and a connecting surface connecting the first surface to the second surface and extending along a circumferential direction of the cap electrode.

7. The rare gas lamp device of claim 1, wherein:

the spring holder further comprises a supporting portion to which a second end of the first fixing part and a second end of the second fixing part are fixed, the supporting portion comprises a fixing protrusion protruding toward each of the plurality of cap electrodes from the supporting portion, each of the plurality of cap electrodes further comprises a fixing hole corresponding to the fixing protrusion, and when the fixing protrusion is inserted in the fixing hole and supported by an inner side of the fixing hole, the lamp body is restricted from moving in an extension direction of the lamp body.

8. The rare gas lamp device of claim 1, wherein:

the spring holder further comprises a supporting portion to which a second end of the first fixing part and a second end of the second fixing part are fixed, each of the plurality of cap electrodes further comprises a fixing protrusion protruding toward the supporting portion, the supporting portion comprises a fixing hole corresponding to the fixing protrusion, and the fixing protrusion is inserted in the fixing hole and supported by the fixing hole.

9. The rare gas lamp device of claim 1, wherein:

each of the plurality of cap electrodes comprises:

a first cap electrode fixed to a first end of the lamp body in one direction, and a second cap electrode fixed to a second end of the lamp body in the one direction, each of the plurality of band electrodes comprises:

a first band electrode connected to the first cap electrode, and a second band electrode positioned on an outer surface of the lamp body in such a way as to be opposite to the first band electrode, the second band electrode extending in the one direction from the cap electrode and connected to the second cap electrode, and a plurality of spring holders in which the first cap electrode and the second cap electrode are respectively inserted are provided.

10. The rare gas lamp device of claim 9, wherein the light-emitting area is positioned between the first band electrode and the second band electrode and aligned with the inserting opening.

11. The rare gas lamp device of claim 1, further comprising a shatter-resistant film surrounding a part of the lamp body and a part of each of the plurality of cap electrodes, wherein a first end of the shatter-resistant film is spaced from the spring holder.

12. The rare gas lamp device of claim 11, wherein a distance between the first end of the shatter-resistant film and the spring holder is 0.1 mm or more.

13. The rare gas lamp device of claim 1, wherein each of the plurality of cap electrodes and the spring holder are made of a metal material.

14. The rare gas lamp device of claim 1, wherein the rare gas lamp device is provided using an External Electrode Fluorescent Lamp (EEFL).

* * * * *